US010014616B2

(12) United States Patent
Schutte et al.

(10) Patent No.: US 10,014,616 B2
(45) Date of Patent: Jul. 3, 2018

(54) ELECTRICAL OUTLET COVER WITH SAFETY LOCK

(71) Applicants: Michael J. Schutte, Cornelius, NC (US); Richard W. Turner, Mooresville, NC (US)

(72) Inventors: Michael J. Schutte, Cornelius, NC (US); Richard W. Turner, Mooresville, NC (US)

(73) Assignee: STAYCONNECT, LLC, Cornelius, NC (US)

( * ) Notice: Subject to any disclaimer, the term of this patent is extended or adjusted under 35 U.S.C. 154(b) by 96 days.

(21) Appl. No.: 14/102,490

(22) Filed: Dec. 10, 2013

(65) Prior Publication Data

US 2014/0162480 A1 Jun. 12, 2014

Related U.S. Application Data

(60) Provisional application No. 61/735,554, filed on Dec. 10, 2012, provisional application No. 61/736,002, filed on Dec. 11, 2012.

(51) Int. Cl.
*H01R 13/447* (2006.01)
*H01R 25/00* (2006.01)

(52) U.S. Cl.
CPC ..... *H01R 13/447* (2013.01); *H01R 25/006* (2013.01)

(58) Field of Classification Search
CPC .... H02G 3/14; H01R 13/447; H01R 13/6397; H01R 13/6395; H01R 13/44
USPC ..... 220/241, 242; 174/53, 55, 56, 57, 66, 174/67; 439/135, 142, 136
See application file for complete search history.

(56) References Cited

U.S. PATENT DOCUMENTS

| | | | |
|---|---|---|---|
| 373,038 | A | 11/1887 | Westinghouse et al. |
| 2,119,428 | A | 5/1938 | Englar |
| 2,197,157 | A | 5/1939 | Heise et al. |
| 2,354,224 | A | 7/1944 | Stein |
| 2,415,602 | A | 2/1947 | Monaco |
| 2,441,643 | A | 5/1948 | Mickler |
| 2,451,982 | A | 10/1948 | Scott |
| 2,455,582 | A | 12/1948 | Hoessel |
| 2,462,756 | A | 2/1949 | Leopold |
| 2,477,803 | A | 8/1949 | Huber |
| 2,487,900 | A | 11/1949 | Sopher |
| 2,507,654 | A | 5/1950 | Stubbs |
| 2,510,745 | A | 6/1950 | Kilgore |
| 2,515,003 | A | 7/1950 | Hamilton |
| 2,516,464 | A | 7/1950 | Hooser |
| 2,524,250 | A | 10/1950 | Bierce |
| 2,526,606 | A | 10/1950 | Gregg |
| 2,528,014 | A | 10/1950 | Moses, Jr. et al. |

(Continued)

*Primary Examiner* — Dimary Lopez Cruz
(74) *Attorney, Agent, or Firm* — Everman Law Firm, P.A.; Gregory R. Everman

(57) ABSTRACT

An outlet cover for an electrical outlet. The outlet cover includes a plate having at least one opening sized and positioned to receive an electrical outlet, a lid hingedly attached to the plate so that the lid can be moved between an open position that allows access to the electrical outlet and a closed position wherein the lid is in a locked position covering the electrical outlet, and a locking assembly having a locking pin. The lid includes a latch which cooperates with the locking pin in order to lock the lid in a closed position or release the lid for opening it for access to the electrical outlet.

6 Claims, 23 Drawing Sheets

(56) References Cited

U.S. PATENT DOCUMENTS 2,559,151 A 7/1951 Getzoff
2,641,627 A 6/1953 Lewis
2,710,382 A 6/1955 Fitzpatrick et al.
2,722,665 A 11/1955 Sauder
2,728,894 A 12/1955 Peters
2,738,475 A 3/1956 Beach
2,744,243 A 5/1956 Menendez
2,752,581 A 6/1956 Benander
2,761,112 A 8/1956 Torcivia
2,818,991 A 1/1958 Hess
2,820,842 A 1/1958 Meistrell
2,880,264 A * 3/1959 Ruskin ..... H01R 13/447 174/504
2,891,102 A 6/1959 Grimes
2,892,172 A 6/1959 McGann, Jr.
2,934,591 A 4/1960 Tiikkainen
2,987,690 A 6/1961 Marbais
2,987,909 A 6/1961 Shlank
2,988,242 A 6/1961 Kneip
2,013,105 A 12/1961 Craig
3,067,402 A 12/1962 Thaw
3,068,442 A 12/1962 Kubik et al.
3,113,174 A 12/1963 Spiteri
3,113,996 A 12/1963 Sanford
3,131,014 A 4/1964 Munoz et al.
3,252,611 A 5/1966 Weitzman et al.
3,317,881 A 5/1967 Setecka
3,428,936 A 2/1969 Arnao, Jr.
3,434,618 A 3/1969 MacDonald
3,467,763 A 9/1969 Shaw
3,491,327 A 1/1970 Tait et al.
3,775,729 A 11/1973 Casper
3,865,456 A 2/1975 Dola
4,070,078 A 1/1978 Chrones
4,083,618 A 4/1978 Busch, Jr.
4,102,466 A 7/1978 Jadatz
4,134,516 A 1/1979 Sullo
4,159,858 A 7/1979 Toraya
4,197,959 A 4/1980 Kramar
4,228,317 A 10/1980 Cziment
4,250,349 A 2/1981 Bennett
4,293,733 A 10/1981 Royer
4,302,624 A 11/1981 Newman
4,424,407 A 1/1984 Barbic
4,451,101 A 5/1984 Davis
4,505,403 A 3/1985 Bowden, Jr. et al.
4,508,933 A 4/1985 Carvel
4,584,430 A 4/1986 Belknap
4,593,541 A 6/1986 Hollis
4,603,932 A 8/1986 Heverly
4,605,817 A 8/1986 Lopez
4,607,136 A 8/1986 Thomas
4,618,740 A 10/1986 Ray et al.
4,660,912 A 4/1987 Tomek
4,702,709 A 10/1987 Santilli
4,711,634 A 12/1987 Antone, II et al.
4,733,017 A 3/1988 Wolfe-Taylor et al.
4,740,655 A 4/1988 Ford
4,743,206 A 5/1988 Imhoff
4,760,215 A 7/1988 Cook et al.
4,774,384 A 9/1988 Gregory
4,793,818 A 12/1988 Poirier
4,798,916 A 1/1989 Engel et al.
4,801,271 A 1/1989 Piper
4,803,307 A 2/1989 Shotey
4,810,833 A 3/1989 Meyers
4,851,612 A 7/1989 Peckham
4,857,004 A 8/1989 Poirier
4,874,906 A 10/1989 Shotey
4,895,999 A 1/1990 Calderon
4,950,842 A 8/1990 Menninga
4,952,755 A 8/1990 Engel et al.
4,952,756 A 8/1990 Meyers
4,968,856 A 11/1990 Bowley et al.
4,970,349 A 11/1990 Jones
4,981,439 A 1/1991 Piedmont
5,045,640 A 9/1991 Riceman
5,078,614 A 1/1992 Shotey
5,080,599 A 1/1992 Wimberly
5,087,796 A 2/1992 Norman
5,096,430 A 3/1992 D'Amico
5,107,075 A 4/1992 Currier, Jr.
5,122,071 A 6/1992 Pridgeon et al.
5,174,773 A 12/1992 Jones
5,195,901 A 3/1993 Correnti
5,198,618 A 3/1993 Shieh
5,212,347 A 5/1993 Powers et al.
5,218,169 A 6/1993 Riceman
5,240,426 A 8/1993 Barla
5,243,135 A 9/1993 Shotey
5,252,083 A 10/1993 Correnti
5,264,662 A 11/1993 Kennedy
5,267,870 A 12/1993 Maresh
5,272,281 A 12/1993 Bouley
5,288,945 A 2/1994 Bruce
5,320,542 A 6/1994 Cheng
5,362,924 A 11/1994 Correnti
5,382,755 A 1/1995 Correnti
5,387,761 A 2/1995 Simonis
5,389,740 A 2/1995 Austin
5,408,046 A 4/1995 Vandeventer
5,430,253 A 7/1995 Pratt
5,474,372 A * 12/1995 Jung ..... H04N 5/64 292/221
5,477,010 A 12/1995 Buckshaw et al.
5,527,993 A 6/1996 Shotey et al.
5,556,289 A 9/1996 Holbrook, Jr.
5,563,373 A 10/1996 Doroslovac
5,571,995 A 11/1996 Pierce
5,589,665 A 12/1996 Scamacca
5,675,126 A 10/1997 Halverson
5,691,507 A 11/1997 Wei
5,703,329 A 12/1997 Delone
5,727,958 A 3/1998 Chen
5,779,083 A 7/1998 Bordwell
5,912,432 A 6/1999 Thomas
5,932,845 A 8/1999 Lacy
5,998,735 A 12/1999 Patterson, Jr.
6,198,046 B1 3/2001 Moodie
6,309,239 B1 10/2001 Johnston
6,342,676 B1 1/2002 Ha
6,372,987 B1 4/2002 Ha
6,545,218 B1 4/2003 Blaess
6,552,262 B2 4/2003 English et al.
6,552,269 B1 4/2003 Conner
6,559,380 B2 5/2003 Soboleski
6,649,838 B1 11/2003 Lopez, Sr. et al.
6,794,575 B1 9/2004 McBain et al.
6,855,887 B1 2/2005 Fox
6,891,104 B2 5/2005 Dinh
7,005,580 B1 2/2006 Craig
7,026,550 B2 4/2006 McBain
7,056,145 B2 6/2006 Campbell, II et al.
7,094,969 B1 8/2006 In
7,097,474 B1 8/2006 Naylor
7,098,403 B2 8/2006 Jolley
7,129,413 B1 10/2006 Roa et al.
7,164,083 B1 1/2007 Carroll
7,396,997 B2 7/2008 Dinh
7,414,193 B1 * 8/2008 Le ..... 174/66
7,456,359 B1 11/2008 Tidd
7,462,777 B2 12/2008 Dinh
7,538,272 B1 5/2009 Shotey et al.
7,541,541 B1 6/2009 Baldwin et al.
7,579,549 B2 8/2009 Jolly
7,595,449 B1 9/2009 Dyderski
7,598,453 B1 * 10/2009 Shotey et al. ..... 174/66
7,619,163 B1 11/2009 Shotey et al.
7,626,121 B1 12/2009 Cleghorn
7,633,009 B1 12/2009 Baldwin
7,652,210 B2 1/2010 White
7,674,975 B2 3/2010 Atkinson et al.
7,674,977 B1 3/2010 Constantino
7,728,226 B2 6/2010 Drane et al.

(56) References Cited

U.S. PATENT DOCUMENTS

| | | | | |
|---|---|---|---|---|
| 7,763,799 | B2 | 7/2010 | Johnson | |
| 7,968,794 | B1 | 6/2011 | Baldwin | |
| 7,977,572 | B1 | 7/2011 | Shotey et al. | |
| 2009/0188693 | A1* | 7/2009 | Simmons | 174/67 |

* cited by examiner

ELECTRICAL OUTLET COVER WITH SAFETY LOCK

CROSS REFERENCE TO RELATED APPLICATIONS

This application claims the benefit of U.S. Provisional Application No. 61/735,554, filed Dec. 10, 2012, and U.S. Provisional Application No. 61/736,002, filed Dec. 11, 2012, both of which are incorporated herein by reference in their entirety.

BACKGROUND OF THE INVENTION

1. Field of the Invention

The present invention relates to the field of safety covers for electrical outlets and, more specifically, to an outlet cover for electrical outlets that has a safety lock to restrict children from accessing the electrical outlet.

2. Description of the Related Art

Numerous devices are known to restrict children from accessing an electrical outlet. For example, a pronged safety plug may be inserted into an outlet. However, when it is desired to use the electrical outlet, the safety plug must be removed whereupon it may be misplaced and lost. Additionally, it is often difficult to grasp and remove the safety plug from the socket.

Other known devices utilize various enclosures or mechanisms to restrict access to an electrical outlet. These devices may be difficult to use, particularly for an elderly person; have removable parts that may become lost; and/or are not self-locking thereby requiring multiple steps in order to limit access to the outlet.

Accordingly, there is a need in the art for continued improvement in the art of electrical outlet covers that have a safety lock to restrict children from accessing an electrical outlet. Further needed in the art is for an electrical outlet cover that this is self-locking. Still further needed is for an outlet cover that does not have any parts that need to be removed when locking or unlocking the outlet cover.

BRIEF SUMMARY OF THE INVENTION

To achieve the foregoing and other objects, the present invention, as embodied and broadly described herein, provides various embodiments of an electrical outlet cover that has a safety lock to restrict children from accessing an electrical outlet.

The present invention is an outlet cover for an electrical outlet. In an embodiment, the outlet cover includes a plate having at least one opening capable of receiving an electrical plug; a lid hingedly attached to the plate so that the lid can be moved between an open position that allows access to the electrical outlet and a closed locked position wherein the electrical outlet is covered by the lid and the lid cannot be freely moved to the open position, the lid having a latch; a locking assembly having a pin movable between an locked position, a transitional position, and an opening position; and wherein the pin secures the latch whereby the lid is locked in a closed position.

In an embodiment the invented outlet cover includes a plate having an opening capable of receiving an electrical plug; a lid hingedly attached to the plate so that the lid can be moved between an open position that allows access to the opening and a closed locked position wherein the opening is covered by the lid and the lid cannot be freely moved to the open position; and a locking assembly have a pin, the locking assembly being moveable between a first position wherein the lid is capable of being locked in the closed position by the pin and an open position wherein the lid may be freely moved to the open position.

BRIEF DESCRIPTION OF THE DRAWINGS

The above described and other features, aspects, and advantages of the present invention are better understood when the following detailed description of the invention is read with reference to the accompanying drawings, wherein.

DESCRIPTION OF THE PREFERRED EMBODIMENTS

The present invention will now be described more fully hereinafter with reference to the accompanying drawings in which preferred embodiments of the invention are shown. This invention may, however, be embodied in many different forms and should not be considered as limited to the embodiments set forth herein. These exemplary embodiments are provided so that this disclosure will be both thorough and complete, and will fully convey the scope of the invention to those skilled in the art. Like reference numbers in the various Figures refer to like elements.

Referring to FIGS. 1-2, 3-12 and 14-22, an electrical outlet cover 10 is illustrated, in accordance with an embodiment of the present invention, for application to an electrical outlet (not illustrated). The outlet cover 10 includes a plate 12 having a shape and size to provide a protective barrier over an electrical box (not shown) in order to keep undesired foreign objects from entering therein; a locking assembly 14; and at least one hinged lid (typically two hinged lids 16*a*, 16*b* are provided to correspond to a pair of sockets as is conventional for electrical outlets) wherein each lid 16*a*, 16*b* may independently and selectively be locked in a closed position to restrict access to a corresponding socket or placed in an open position by being rotated outwardly relative to the plate 12 to allow access to a corresponding socket. Advantageously, the invented outlet cover 10 provides a measure of safety against accidental electrocution from an electrical outlet, particularly with regards to infants and young children.

Figure 1:
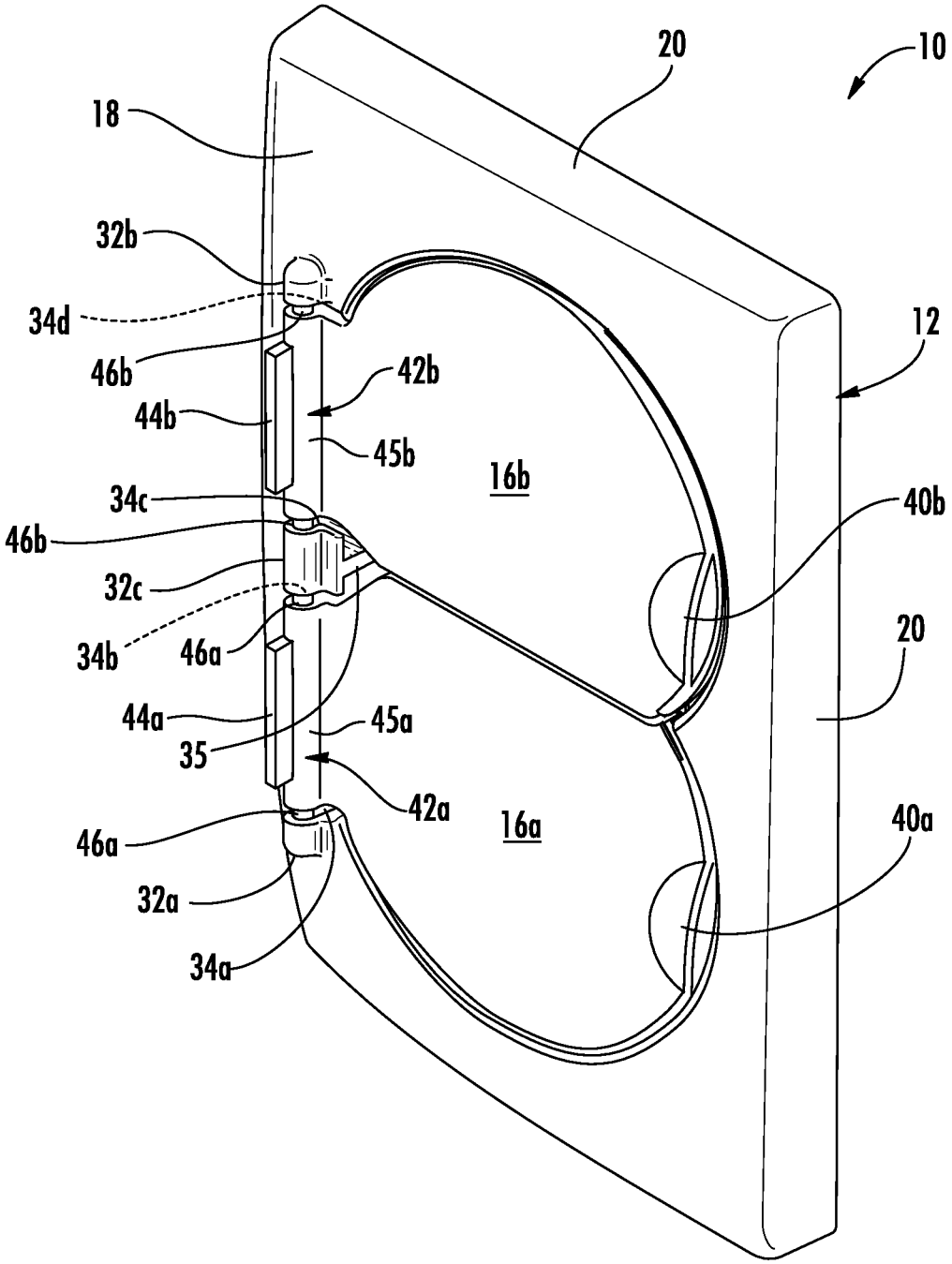
FIG. 1 is a top, left, front perspective view of an electrical outlet cover, in accordance with an embodiment of the present invention.
Figure 2:
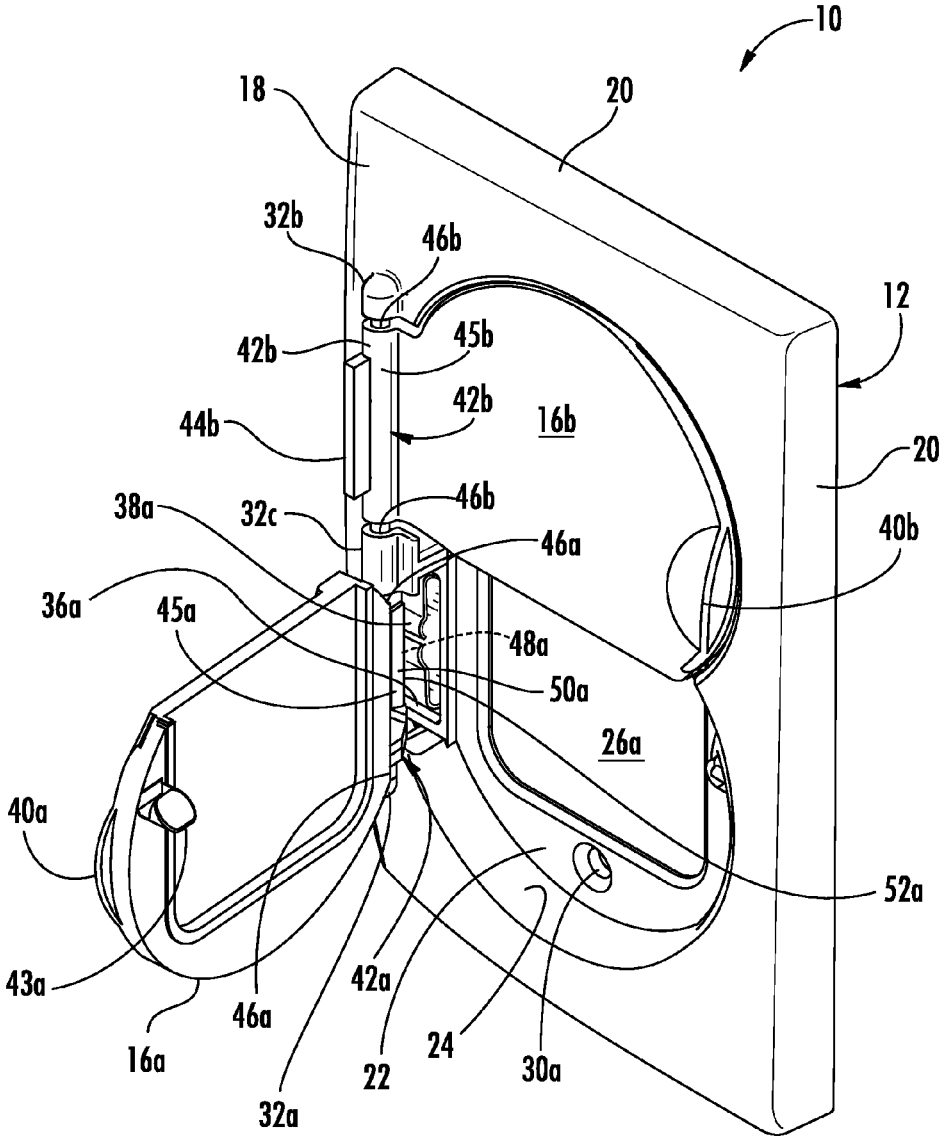
FIG. 2 is a top, left, front perspective view of the electrical outlet cover of FIG. 1, showing a lid of the outlet cover in an open position and the other lid locked in a closed position.
Figure 2A:
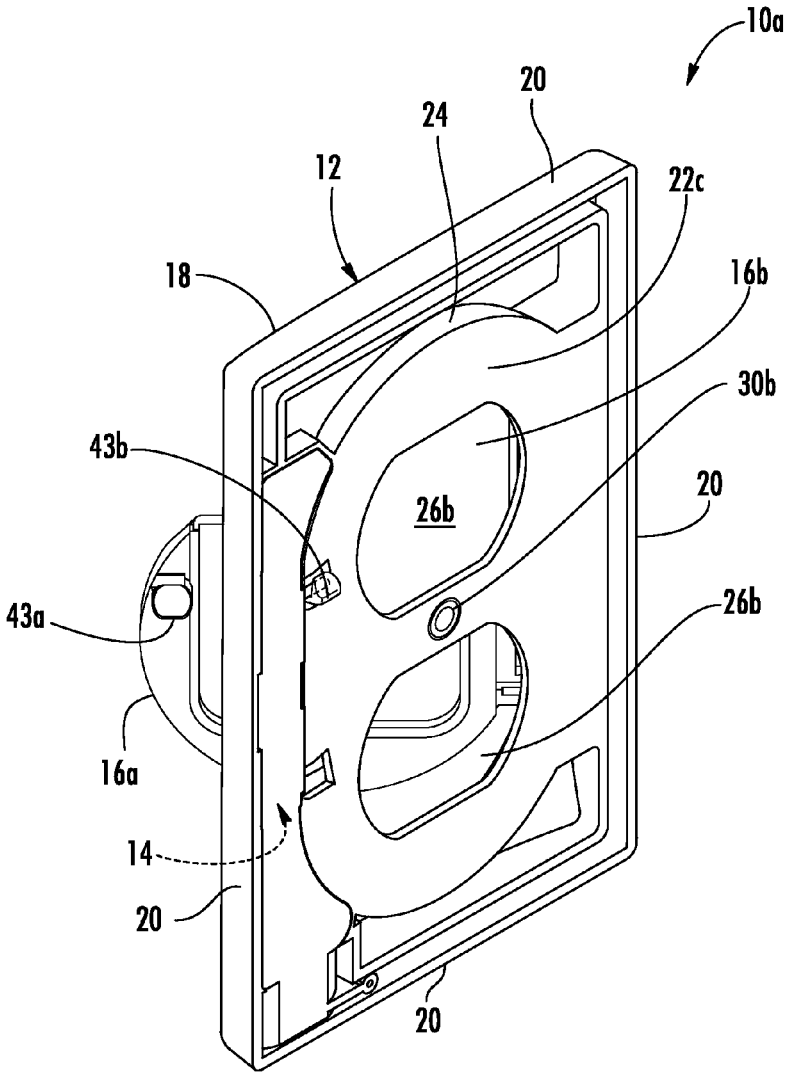
FIG. 2A is top, left, rear, perspective view of an electrical outlet cover similar to the outlet cover of FIG. 2, except that it has preexisting openings configured for application to a standard electrical outlet.
Figure 3:
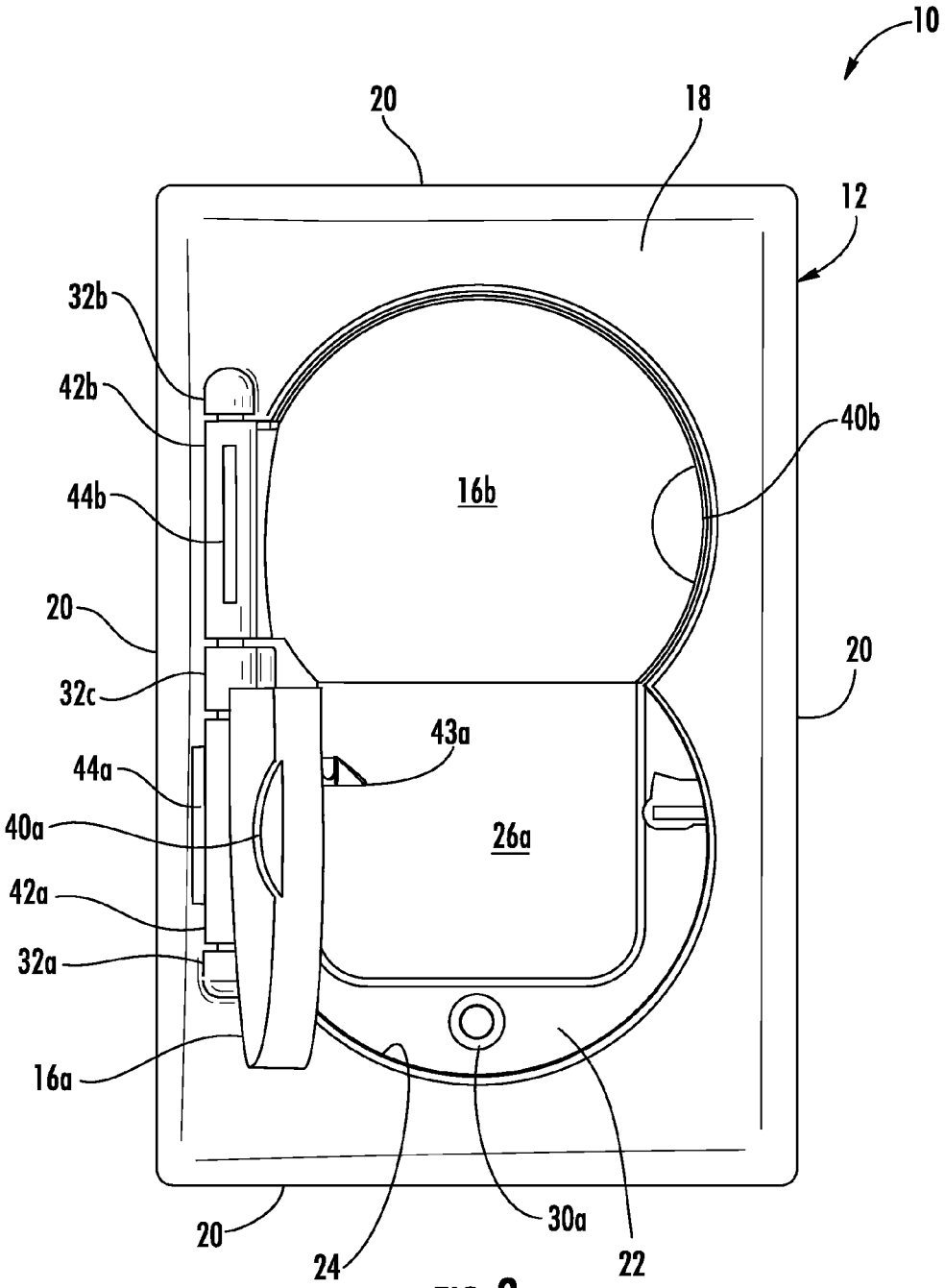
FIG. 3 is a front view of the electrical outlet cover of FIG. 2.
Figure 4:
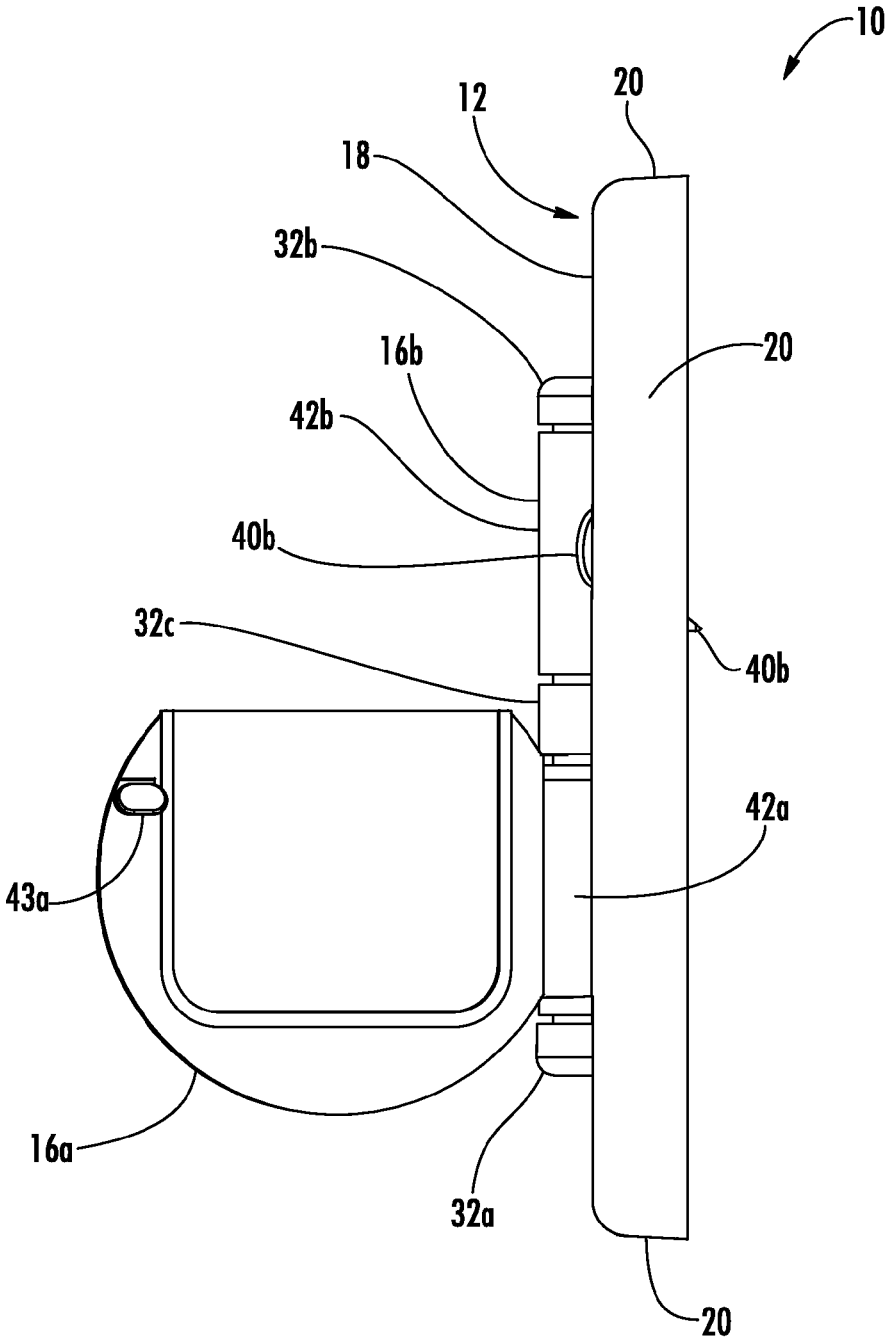
FIG. 4 is a left side elevational view of the outlet cover of FIG. 2.

Referring to FIG. 2, the plate 12 has an exterior first section 18, a perimeter wall 20, a second section 22 spaced inward from the first section 18 by a connecting wall 24. One or more openings are provided in the second section 22 so that a plug may pass there-through to access a socket. For example and as illustrated in FIGS. 2, 3-12 and 14-16, an opening 26*a* provided in the second section 22 of the plate 12 may be shaped and sized to be suitable for use with a GFI receptacle, in particular a GFI receptacle duplex. An another example and referring to FIGS. 17-22, the opening 26*a* may also be adapted with interchangeable templates 28*a*, 28*b* for application of the outlet cover 10 to a standard electrical outlet (see FIGS. 17-19) or GFI outlet (see FIGS. 20-22). As a further example, FIG. 2A illustrates an alternative embodiment of an outlet cover 10*a*, having the same or substantially similar components (e.g. plate 12 with first section 18, perimeter edge 20 and connection wall 24; lids 16*a*, 16*b* with latches 43*a*, 43*b*; locking assembly 14; and etc.) as in the embodiment of outlet cover 10, except for configuration of the second section 22*c* which defines a pair of openings 26*b* that is suitable for use with a standard duplex receptacle. Thusly, outlet cover 10*a* is premade for application to a standard electrical outlet without use of the template 28*a* (see FIGS. 17-19).

Figure 7:
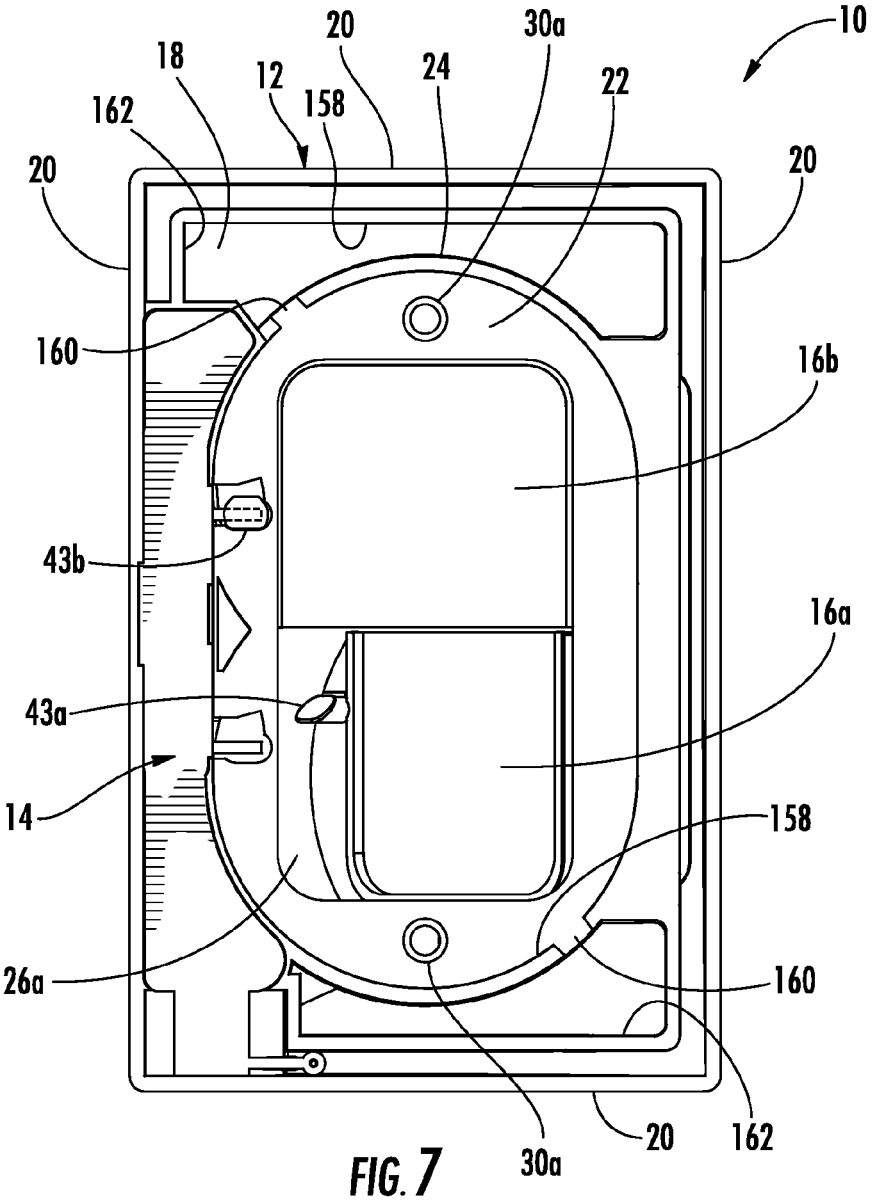
FIG. 7 is a rear view of the outlet cover of FIG. 2.
Figure 8:
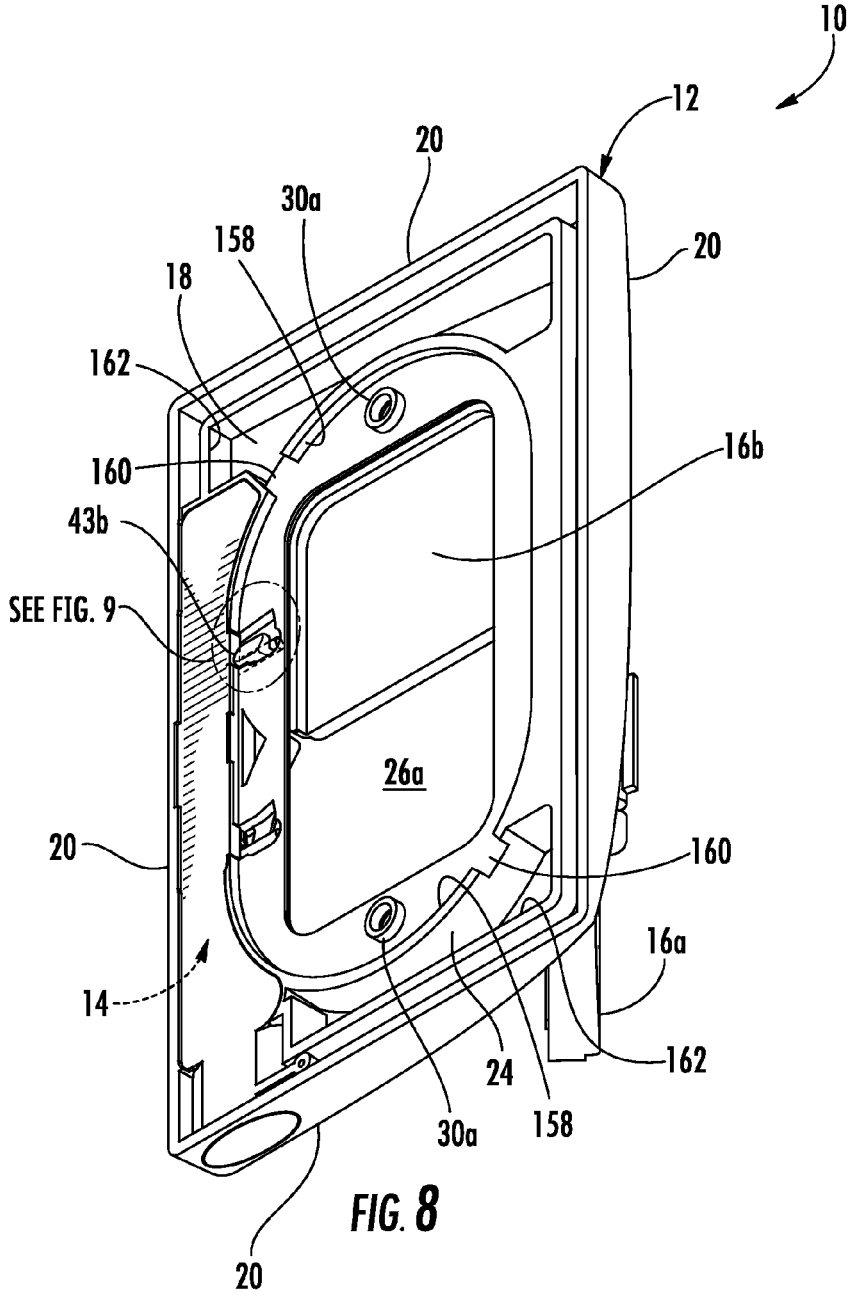
FIG. 8 is a bottom, right, rear perspective view of the outlet cover of FIG. 2.

One or more small apertures, for example the pair of apertures 30*a* illustrated in FIG. 7 or the single aperture 30*b* illustrated in FIG. 2A, are also provided in the second section 22, 22*c* for securing the outlet cover 10, 10*a* to the electrical outlet via at least one mechanical fastener, for example with screws.

Figure 5:
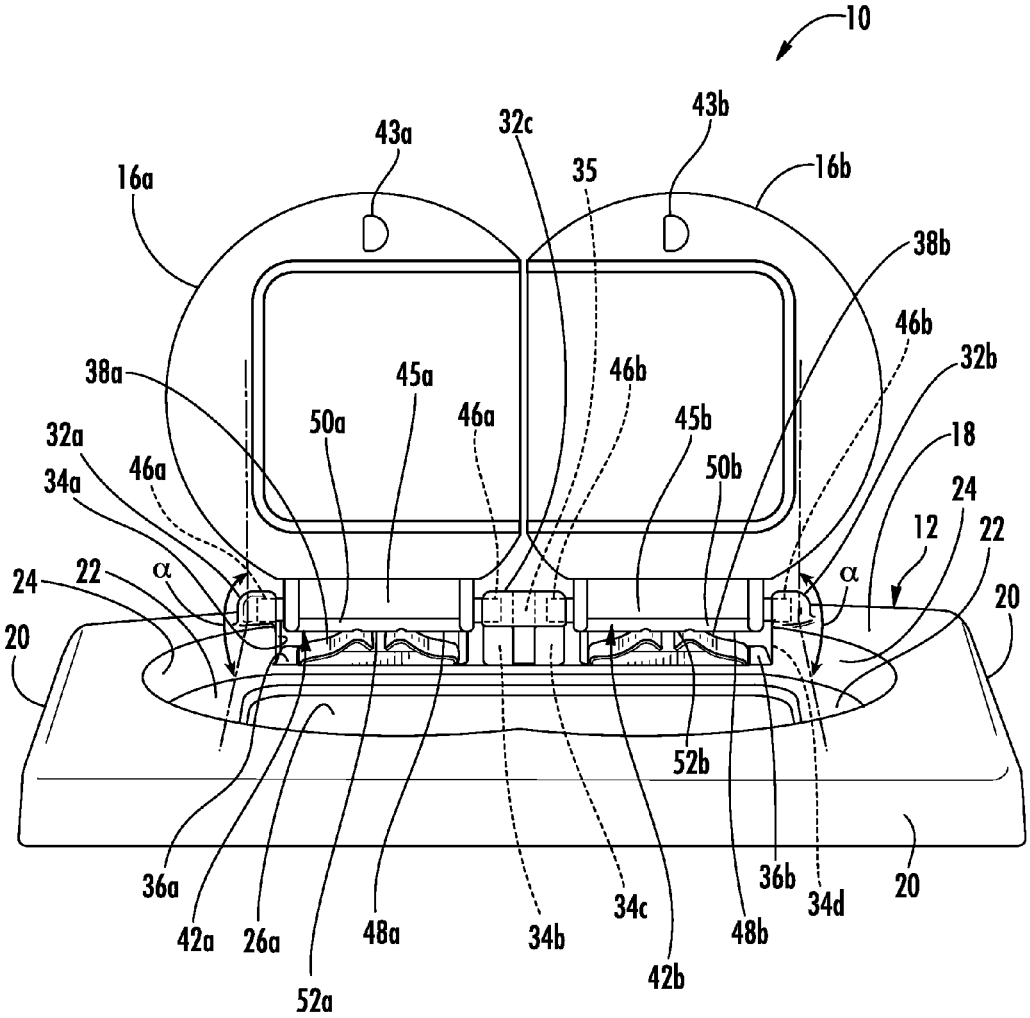
FIG. 5 is front, left, perspective view the outlet cover of FIG. 2, but showing both lids of the outlet cover in open position.
Figure 6:
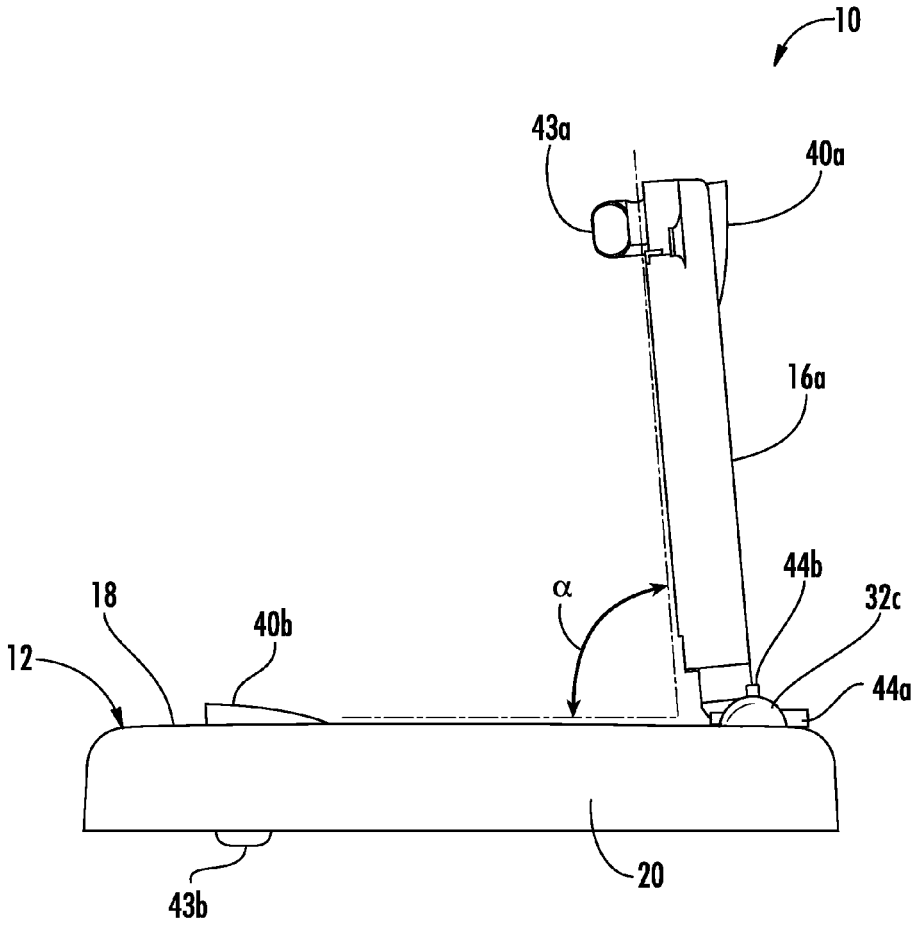
FIG. 6 is a top plan view of the outlet cover of FIG. 2.

Referring to FIG. 5, the plate 12 also includes projected end housings 32*a*, 32*b* and a projected intermediate housing 32*c* which serve to secure the lids 16*a*, 16*b* to the base plate 12 and allow relative rotation between the lids 16*a*, 16*b* and plate 12. Each end housing 32*a*, 32*b* includes a channel 34*a*, 34*d*, and the intermediate housing 32*c* includes a pair of channels 34*b*, 34*c* divided by a central wall 35. Alternatively, but less preferred, the intermediate housing 32*c* may have a continuous singular channel (not illustrated), i.e. without the central wall 35, that serves the same purpose as the pair of channels 34*b*, 34*c*. Each of the channels 34*a*-34*d* has a depth, being elongate from their respective housing 32*a*-32*c* and extending rearward to below the first section 18 of the plate 12. The depth of the channels 34*a*-34*d* allows access for mounting the lids 16*a*, 16*b* within the housing 32*a*-32*c* during assembly of the outlet cover 10. The plate 12 further includes recesses 36*a*, 36*b* into which respective springs 38*a*, 38*b* are disposed.

Each lid 16*a*, 16*b* includes an outer lip 40*a*, 40*b* (FIG. 2) for aiding a person in gripping when opening the lid 16*a*, 16*b*; a shaft 42*a*, 42*b* for rotatably attaching the lid 16*a*, 16*b* to respective housings 32*a*-32*c* thereby allowing relative rotation between the lid 16*a*, 16*b* and the plate 12; a latch 43*a*, 43*b* that is used in conjunction with the locking assembly 14 for locking the lid 16*a*, 16*b* in the closed position; and a raised projection 44*a*, 44*b* (FIG. 1) that limits the degree to which the lids 16*a*, 16*b* can be rotated in the open direction before being stopped by engaging the plate 12 and may also be used to rotate the lid 16*a*, 16*b* open by pushing against the projection 44*a*, 44*b*.

Each shaft 42*a*, 42*b* includes an intermediate portion 45*a*, 45*b* and opposed end portions 46*a*, 46*b* that extend into the respective housings 32*a*-32*c*. Although other shaft configurations may be suitable, it is preferred that the intermediate portion 45*a*, 45*b* of each shaft 42*a*, 42*b* includes first and second surfaces 48*a*, 48*b*, 50*a*, 50*b* separated by a transitional edge or section 52*a*, 52*b*.

When in the fully open position, for example when an angle $\alpha$ between the lid 16*a*, 16*b* and first section 18 is in a range of 65 degrees to 120 degrees, more preferably in a range of 70 degrees to 100 degrees, and most preferably in a range of 80 degrees to 90 degrees, the spring 38*a*, 38*b* resiliently presses against the first surface 48*a*, 48*b* with sufficient force to hold the lid 16*a*, 16*b* in the open position.

Upon beginning to close the lid 16*a*, 16*b*, for example when the angle $\alpha$ between the lid 16*a*, 16*b* and first section 18 is less than 65 degrees, more preferably less than 70 degrees, and most preferably less than 90 degrees, the transitional section 52*a*, 52*b* is rotated onto the spring 38*a*, 38*b* causing the spring to act with force against on the transitional section 52*a*, 52*b* and thereby cause the lid 16*a*, 16*b* to close with sufficient force to lock the lid 16*a*, 16*b* in a closed position with the locking assembly 14. That is, by moving the lid 16*a*, 16*b* from the open position towards the closed position, the spring 38*a*, 38*b* will automatically close the lid 16*a*, 16*b* with sufficient force to activate the locking assembly 14. Advantageously, once placed in the open position, the lid 16*a*, 16*b* remains open allowing access to insert a plug an associated electrical outlet without interference of the lid 16*a*, 16*b*. To lock the lid 16*a*, 16*b* in the closed position, a person simply rotates the lid 16*a*, 16*b* towards the closed position by a few degrees until the spring

38*a*, 38*b* applies proper force to swing the lid 16*a*, 16*b* shut whereupon the locking assembly 14 secures the lid 16*a*, 16*b* in the closed position.

Alternatively, the outlet cover 10 may be configured whereby engagement between the spring 38*a*, 38*b* and shaft 42*a*, 42*b* is insufficient to maintain the lid 16*a*, 16*b* in the opened position, instead biasing the lid 16*a*, 16*b* towards the closed position. In this alternative, a person would need to hold open the lid 16*a*, 16*b* while inserting a plug into a corresponding socket. Upon release, the lid 16*a*, 16*b* would rest against the power cord or plug. In this embodiment, should the plug become disengaged from the outlet, unintentionally or otherwise, the lid 16*a*, 16*b* would automatically close under force of the spring 38*a*, 38*b* and become locked in the closed position.

Figure 9:
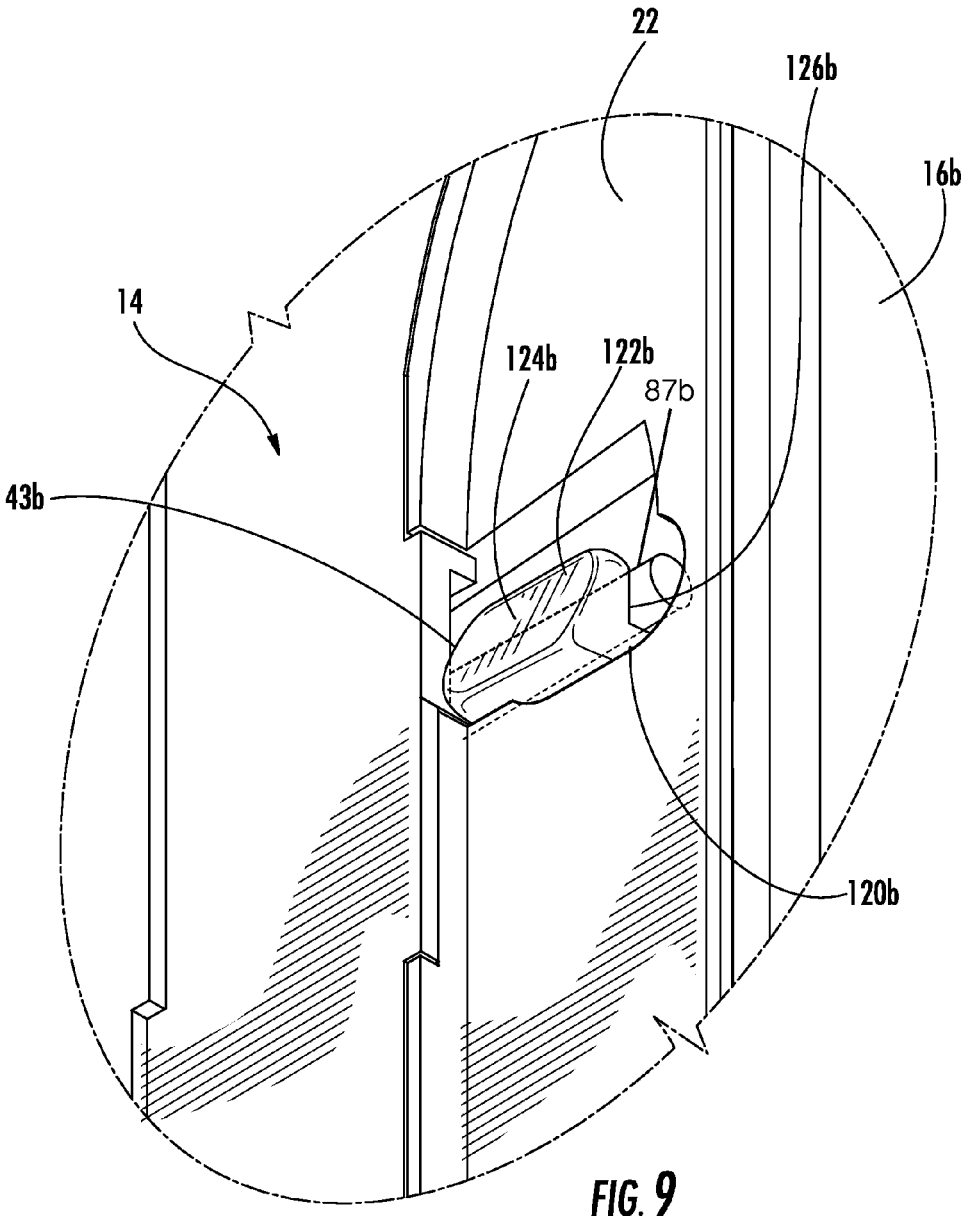
FIG. 9 is a detail taken from FIG. 8, showing a latch and pin for locking a lid of the outlet cover.
Figure 10:
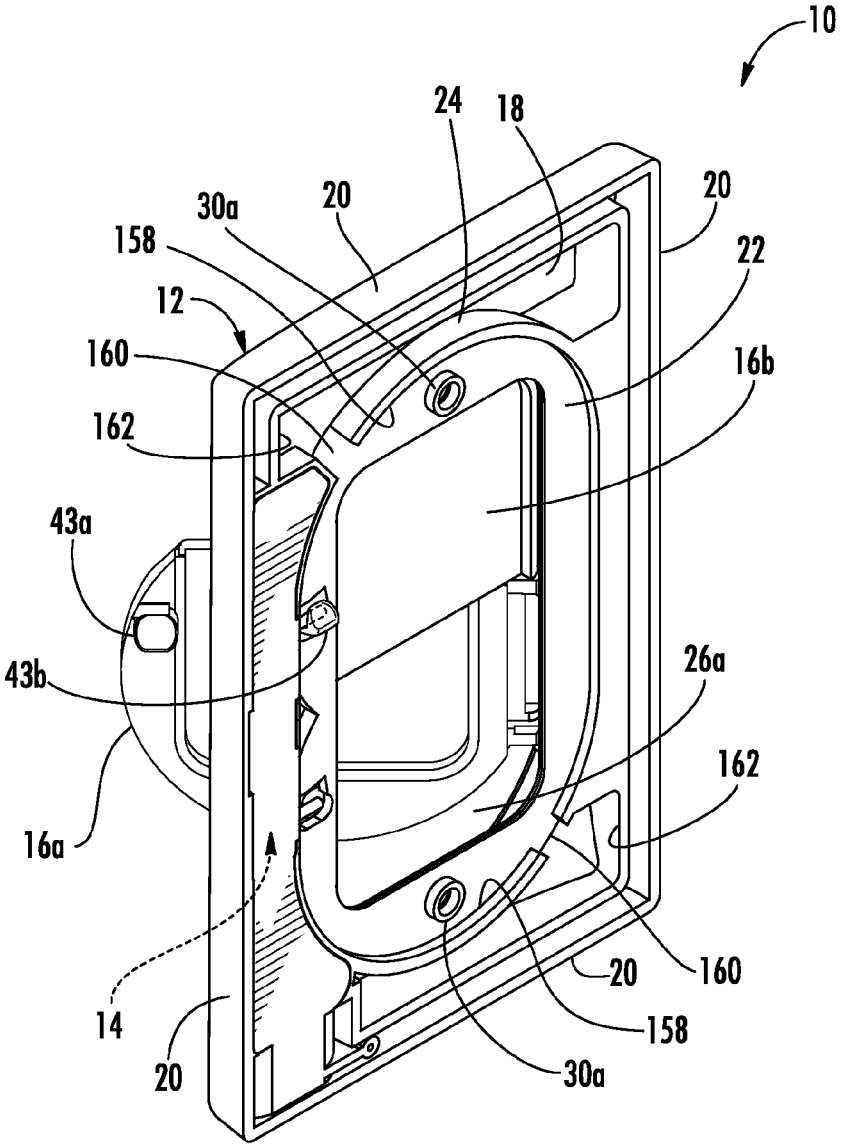
FIG. 10 is a top, left, rear perspective view of the outlet cover of FIG. 2.

Referring to FIG. 9, the latch 43*b* includes first portion that extends from the lid 16*b*, and a second portion 122*b* forming an enlarged head of the latch 43*b*, the second portion 122*b* having a sloped surface 124*b* angled distally inwardly. The latch 43*b* defines a catch 126*b* for holding the second locking pin 87*b*. Each latch 43*a*, 43*b* has the same configuration and functionality. As such, the description of latch 43*b* equally applies to, and is incorporated into, the description of latch 43*a* (FIG. 2).

Figure 11:
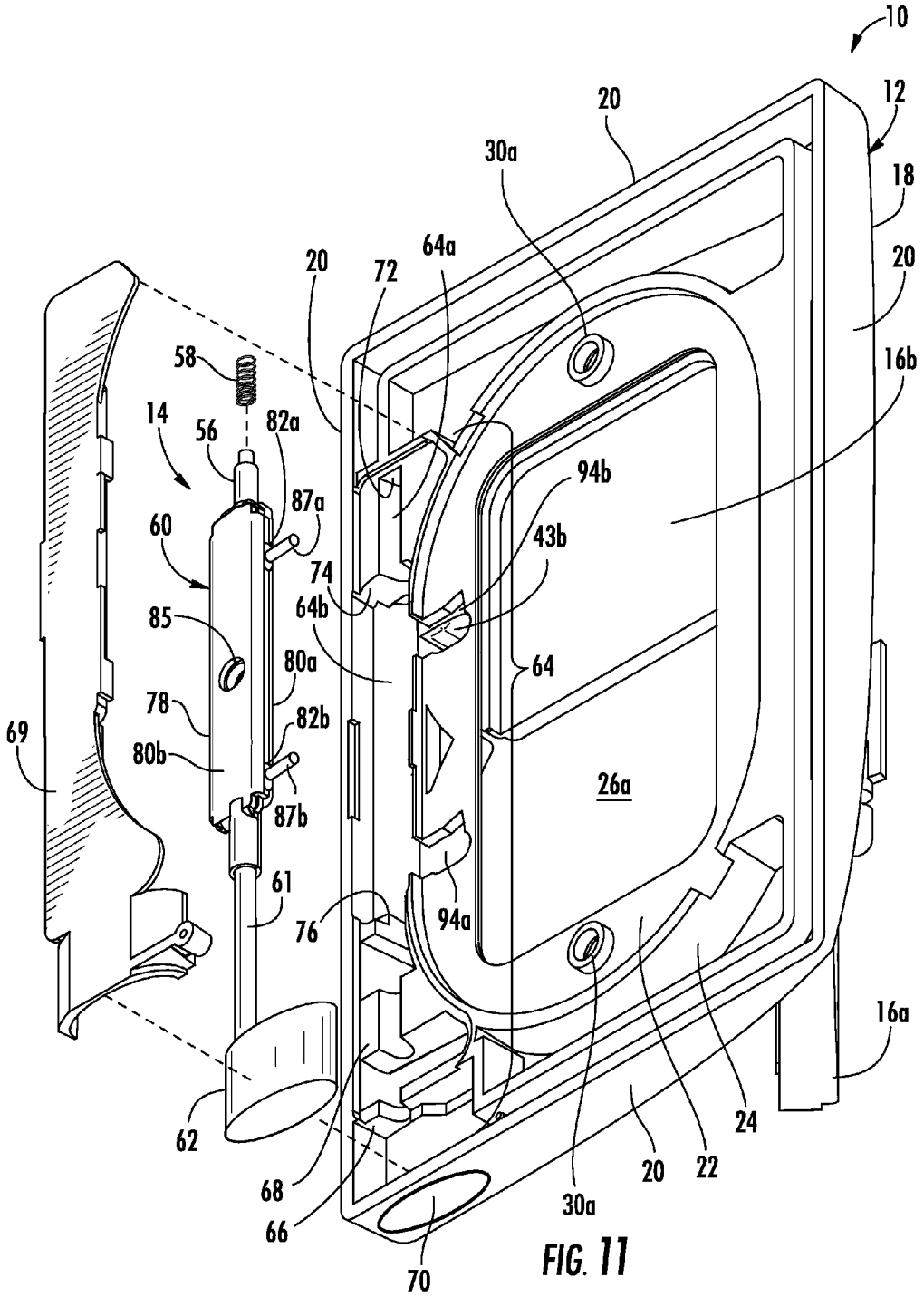
FIG. 11 is a bottom, right, rear perspective view of the outlet cover of FIG. 10, showing a locking assembly exploded from the outlet cover.
Figure 12:
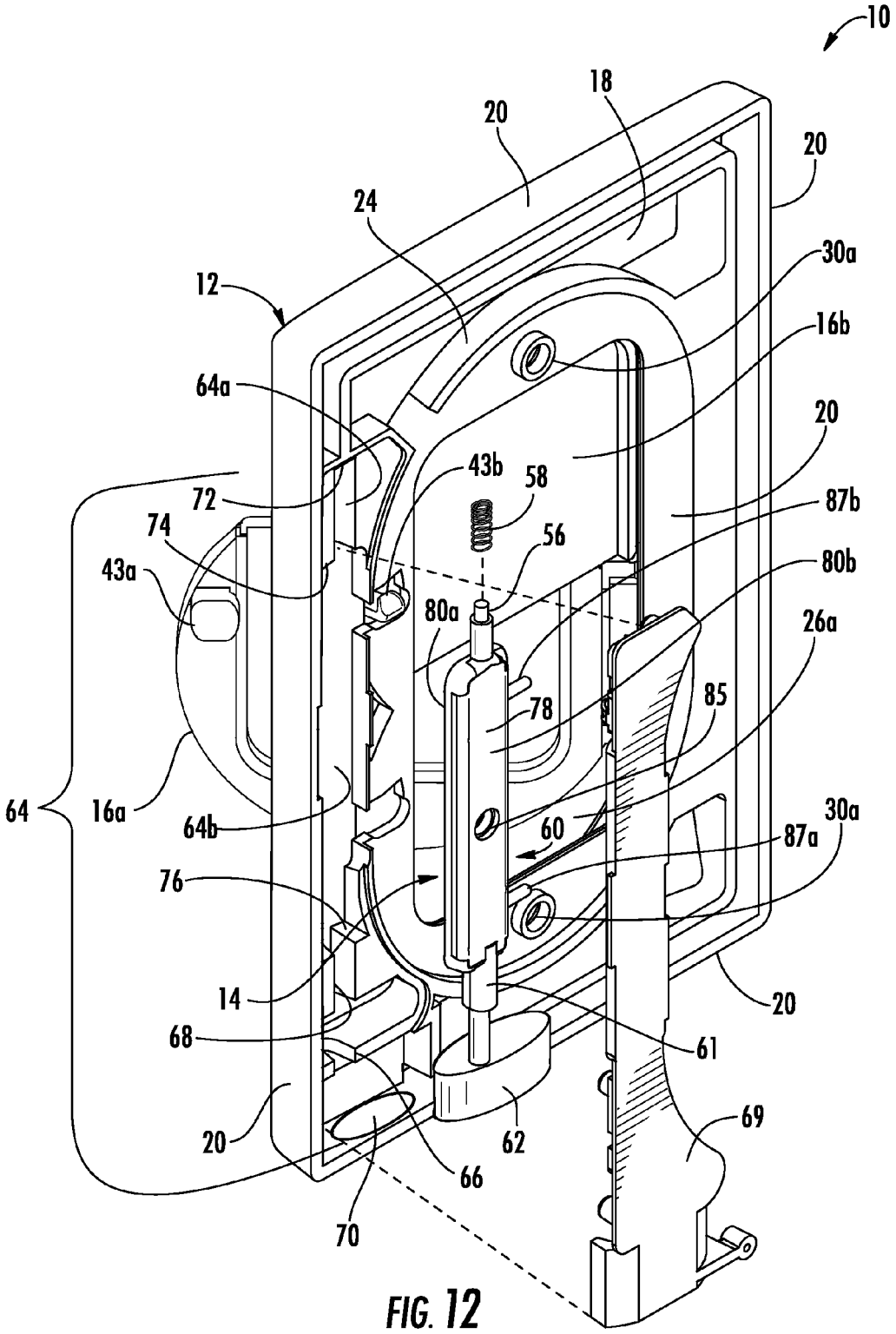
FIG. 12 is a top, left, rear perspective view of the outlet cover of FIG. 10, showing a locking assembly exploded from the outlet cover.
Figure 13:
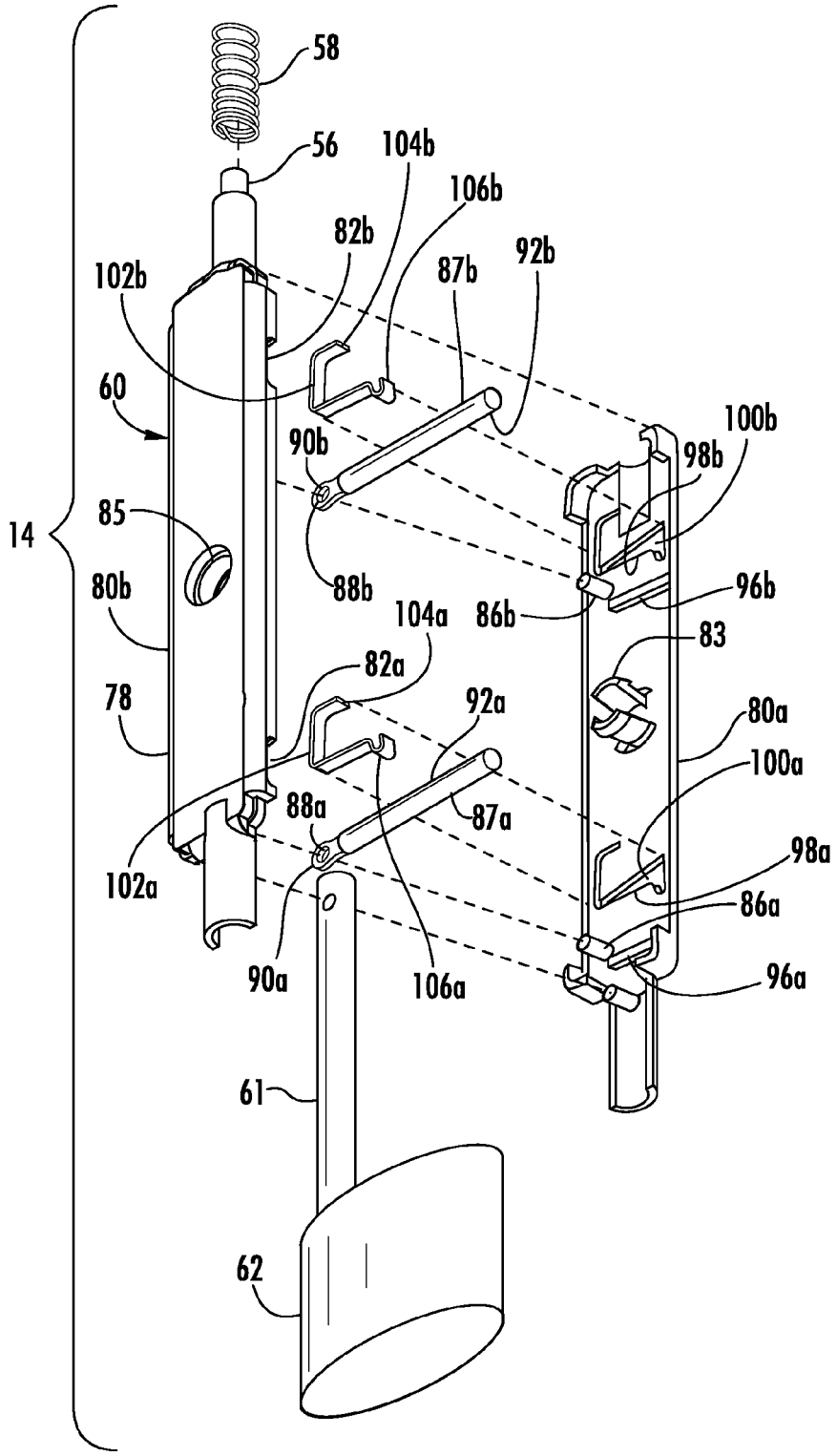
FIG. 13 is an exploded perspective view of the locking assembly of FIG. 11.

Referring to FIGS. 11 to 13, the locking assembly 14 includes a distal stepped shaft 56 which carries a spring 58, an intermediate body 60 attached to the distal shaft 56, and a proximal shaft 61 attached to the intermediate body 60, the proximal shaft 61 having an enlarged end 62 which serves as a button for actuation by a person. Structures of the plate 12 form a channel 64 in which the locking assembly 14 resides thereby limiting the locking assembly 14 to a predetermined range of movement. For example, such structures include a distal channel portion 64*a* into which the distal shaft 56 and spring 58 are disposed, intermediate channel portion 64*b* into which the intermediate body 60 is disposed, first and second lateral structures 66, 68 having channel portions into which the proximal shaft resides. A cover 69 is provide for enclosing the locking assembly 14 within the channel 64.

Figure 14:
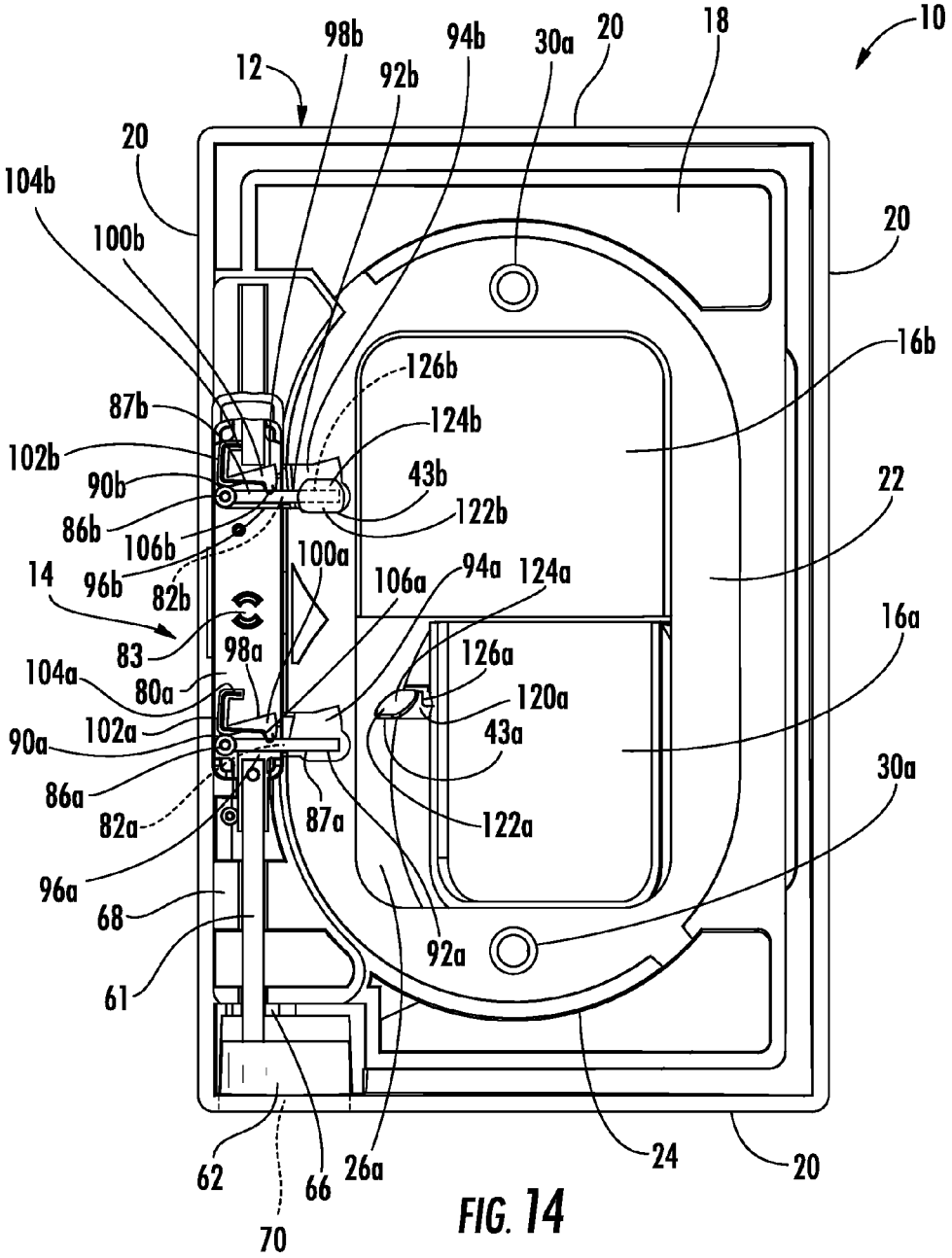
FIG. 14 is a rear view of the outlet cover of FIG. 2, showing interior details of a locking assembly with first and second locking pins being located in a locking position.
Figure 16:
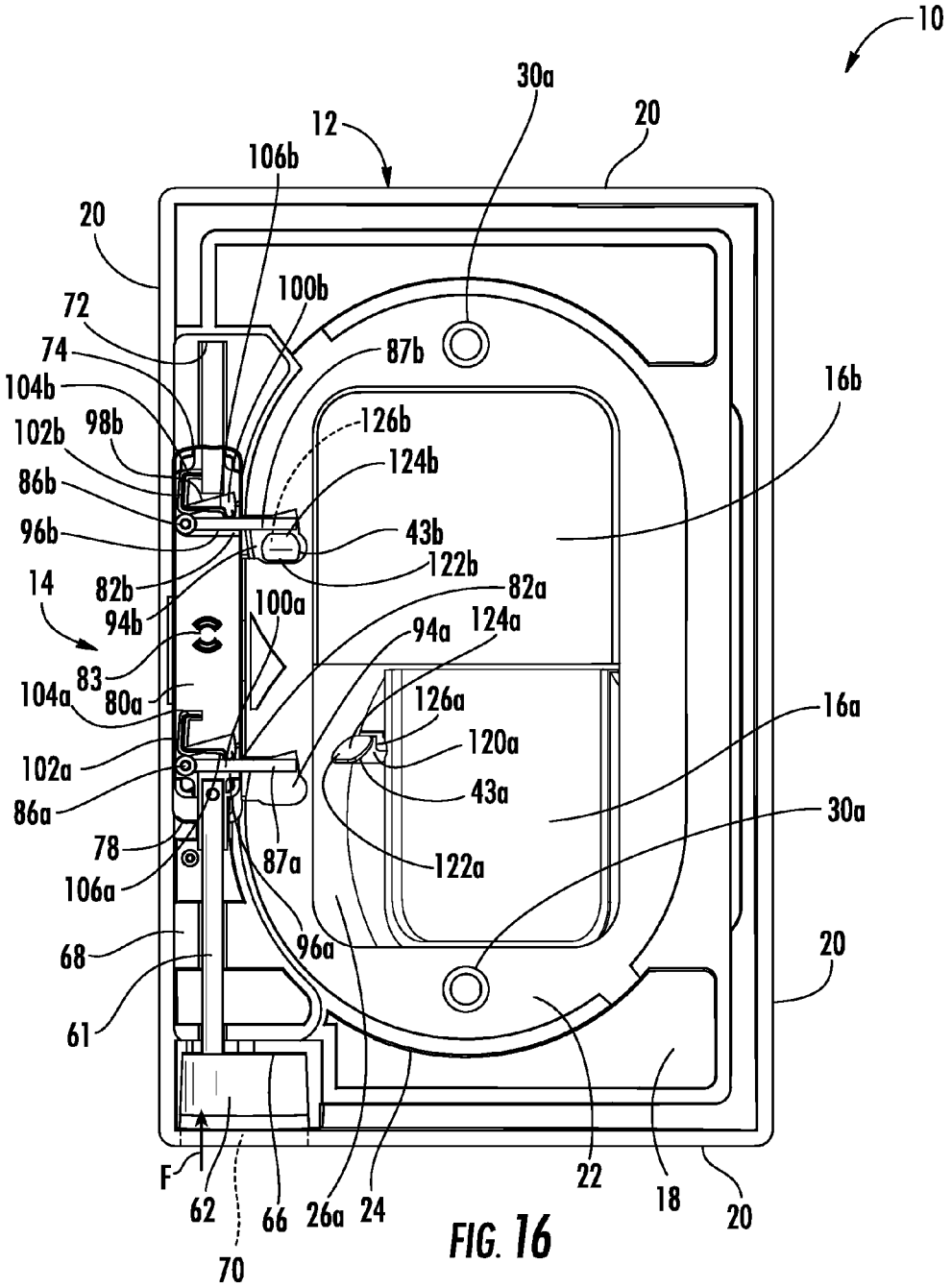
FIG. 16 is a rear view of the outlet cover of FIG. 2, showing interior details of a locking mechanism with first and second locking pins being located in an unlocking position whereby each lid may freely be rotated to the open position for access to an electrical outlet.

FIG. 14 illustrates the locking assembly 14 being located in a first position whereat it is capable of locking the lid 16*a*, 16*b* in the closed position. An opening 70 is provided in the perimeter wall 20 of the plate 12, thereby allowing a person access with a finger to push the button formed by the enlarged proximal end 62. Referring to FIG. 16, by pushing the enlarged proximal end 62 (indicated by arrow F), the locking assembly 14 is caused to move longitudinally further into the plate 12 to a second position thereby compressing the spring 58 between the locking assembly 14 and distal channel end wall 72. Inward travel is limited by engagement between the locking assembly 14 and a wall defining the channel 64 such as, for example, engagement between the intermediate body 60 and a distal wall 74 of the intermediate channel portion 64*b* and/or engagement between the enlarged proximal end 62 and first lateral structure 66. At the second position, the lids 16*a*, 16*b* may freely be moved to the open position, unrestricted by the locking assembly 14.

Upon release of applied force (F) to the enlarged proximal end 62, the locking assembly 14 returns to the first position as illustrated in FIG. 14. In particular, the spring 58 resiliently urges the locking assembly 14 towards the opening 70 until the locking assembly 14 engages a wall defining the channel 64 such as, for example, by engagement between the intermediate body 60 and a proximal wall 76 of the intermediate channel portion 64*b*. Ideally, the enlarged proximal end 62 is flush or slightly recessed with the perimeter wall 20 in order to be less apparent to infants and small children. To avoid detection it is also preferred to orient the outlet cover 10 so that the enlarged proximal end 62 is at the bottom of cover 10 facing a floor.

Referring to FIGS. 11-13, the intermediate body 60 includes a housing 78 having first and second sections 80*a*, 80*b* and first and second apertures 82*a*, 82*b* through which first and second locking pins 87*a*, 87*b* extend. The first section 80*a* includes a prong 83 (FIG. 13) whereas the second section 80*b* includes a corresponding opening 85 in order to snap the sections 80*a*, 80*b* together to form the housing 78. Other mating features, or means for attaching such as adhesives, fasteners or the like, may be provided to secure the first and second sections 80*a*, 80*b* together.

Referring to the FIGS. 13-16, the second section 80*b* (FIG. 13) is removed from the first section 80*a* in order to illustrate details within the body 60. The body 60 includes first and second pegs 86*a*, 86*b* which extend from the first section 80*a*; first and second elongate pins 87*a*, 87*b*, each having an opening 88*a*, 88*b* (FIG. 13) at a first end portion 90*a*, 90*b* for rotatably mounting the pins 87*a*, 87*b* on respective first and second pegs 86*a*, 86*b* and a second end portion 92*a*, 92*b* having a sufficient length so to extend through respective first and second apertures 82*a*, 82*b* and into respective openings 94*a*, 94*b* (FIGS. 14-15) provided within the second section 22 of the plate 12; first and second distal walls 96*a*, 96*b* which provide an abutment to restrict the degree of pin 86*a*, 86*b* rotation proximally; first and second wall structures 98*a*, 98*b*, which in combination with the first and second housing sections 80*a*, 80*b* (see FIGS. 11-13 for housing section 80*b*) define respective first and second compartments 100*a*, 100*b*; first and second springs 102*a*, 102*b* disposed within respective first and second compartments 100*a*, 100*b*; and each of the first and second springs 102*a*, 102*b* having a first and second end portions 104*a*, 104*b*, 106*a*, 106*b*, the first end portions 104*a*, 104*b* being tightly fitted within the respective compartment 100*a*, 100*b* such that the first portions 104*a*, 104*b* are fixed in location relative to the compartment 100*a*, 100*b*, the second end portions 106*a*, 106*b* being able to move annularly within the compartments 100*a*, 100*b*, preferably by a range of at least 5 degrees to up to 45 degrees, more preferably at least 5 degrees up to 35 degrees, and most preferably by a range of at least 5 degrees to no more than 25 degrees, before being stopped by engaging respective wall structures 98*a*, 98*b*. The second end portions 106*a*, 106*b* of the first and second springs 102*a*, 102*b* engage respective first and second locking pins 87*a*, 87*b* thereby continuously applying force to rotate the pins 87*a*, 87*b* proximally towards the locking position.

During use, the pins 87*a*, 87*b* may be located in the locking position, intermediate position and unlocking position. The following examples are illustrative of methods of use of the locking assembly 14 of the outlet cover 10.

Referring to FIG. 14, when the locking assembly 14 is in the first position and the lids 16*a*, 16*b* are either in the open position (lid 16*a*) or closed locked position (lid 16*b*), then the first and second locking pins 86*a*, 86*b* are in the locking position. When a pin (e.g. 87*b*) is in the locking position and a corresponding lid (e.g. 16*b*) is simultaneously in the closed position, the locking assembly 14 will cause the lid 16*b* to be locked in the closed position. Referring to FIG. 16, to release the lid 16*b*, force (F) is applied to enlarged end 62 causing the locking assembly 14 to move from a first position to a second position, carrying the pin 87*b* from the locking position to the unlocking position.

Figure 15:
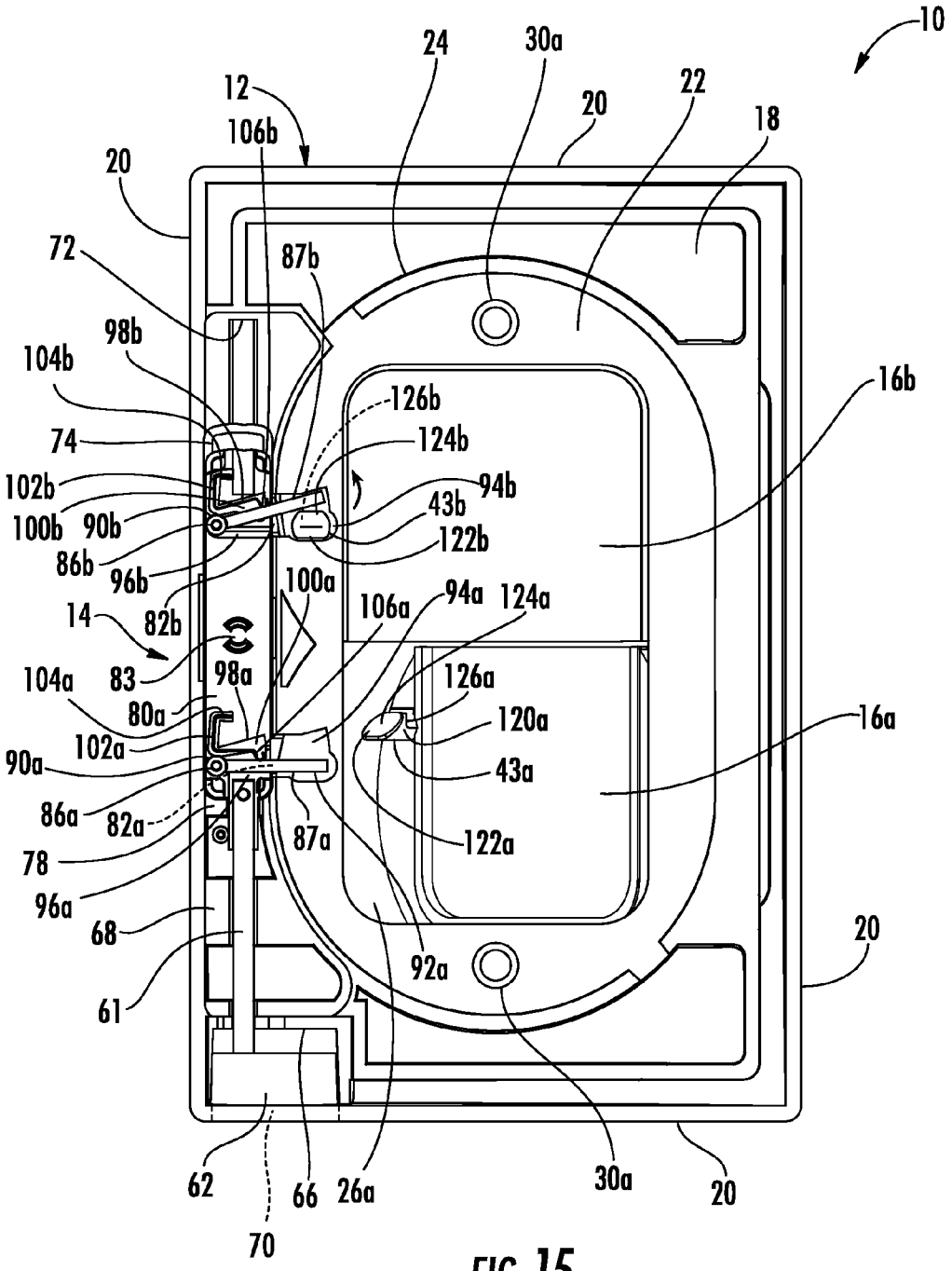
FIG. 15 is a rear view of the outlet cover of FIG. 2, showing interior details of a locking assembly with a first locking pin being located in a locking position and securing a first lid in a closed position and a second locking pin in an intermediate position wherein a second lid is being returned from an open position to a closed locked position.

Referring to FIG. 15, when the locking assembly 14 is in the first position and a lid, e.g. lid 16*b*, is in the transitional position, then the locking pin, e.g. second pin 87*b*, is in the intermediate position between the locking position and unlocking position. (See FIG. 15 for an arrow indicating the motion of the second pin 87*b* from the locking position, through the intermediate position, to the unlocking position). The lid 16*b* is in the transitional position when the sloped surface 124*b* of the latch 43*b* is engaged with the second locking pin 87*b* as occurs just before the lid 16*b* reaches the closed position. As the lid 16*b* is closing, the latch 43*b* engages the second pin 87*b* causing the pin 87*b* to slide over the sloped surface 124*b* while pivoting in a generally distal direction (see arrow in FIG. 15) until the second portion 122*b* has moved past the second pin 87*b*. Thereafter, the second pin 87*b* will be caused, under the force of the second spring 102*b*, to move into the locking position where it resides in the catch 126*b* of the latch 43*b*. In this position, the lid 16*b* is unable to be opened due to engagement of the second portion 122*b* against the second locking pin 87*b* until the locking assembly 14 is moved to the second position.

Referring to FIG. 16, upon applying sufficient force (F) on the enlarged proximal end 62, the locking assembly 14 is caused to move longitudinally distally from the first position to the second position, carrying the first and second pins 86*a*, 86*b* from the locking position to the unlocking position whereby the lids 16*a*, 16*b* can be freely rotated to the open position.

Figure 17:
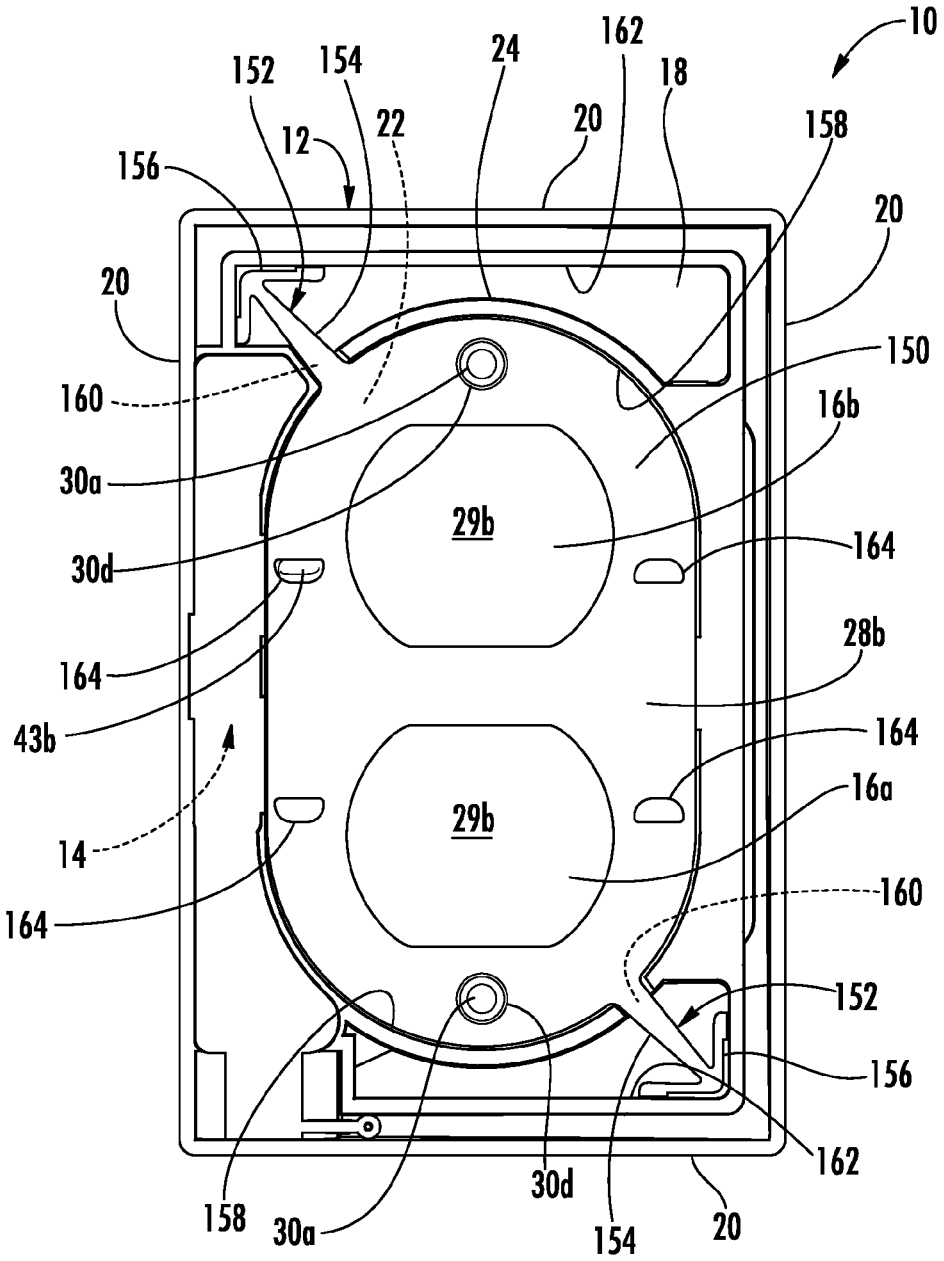
FIG. 17 is a rear view of the outlet cover of FIG. 2, further showing a template insert suitable for accommodating application of the cover to a standard electrical outlet.
Figure 18:
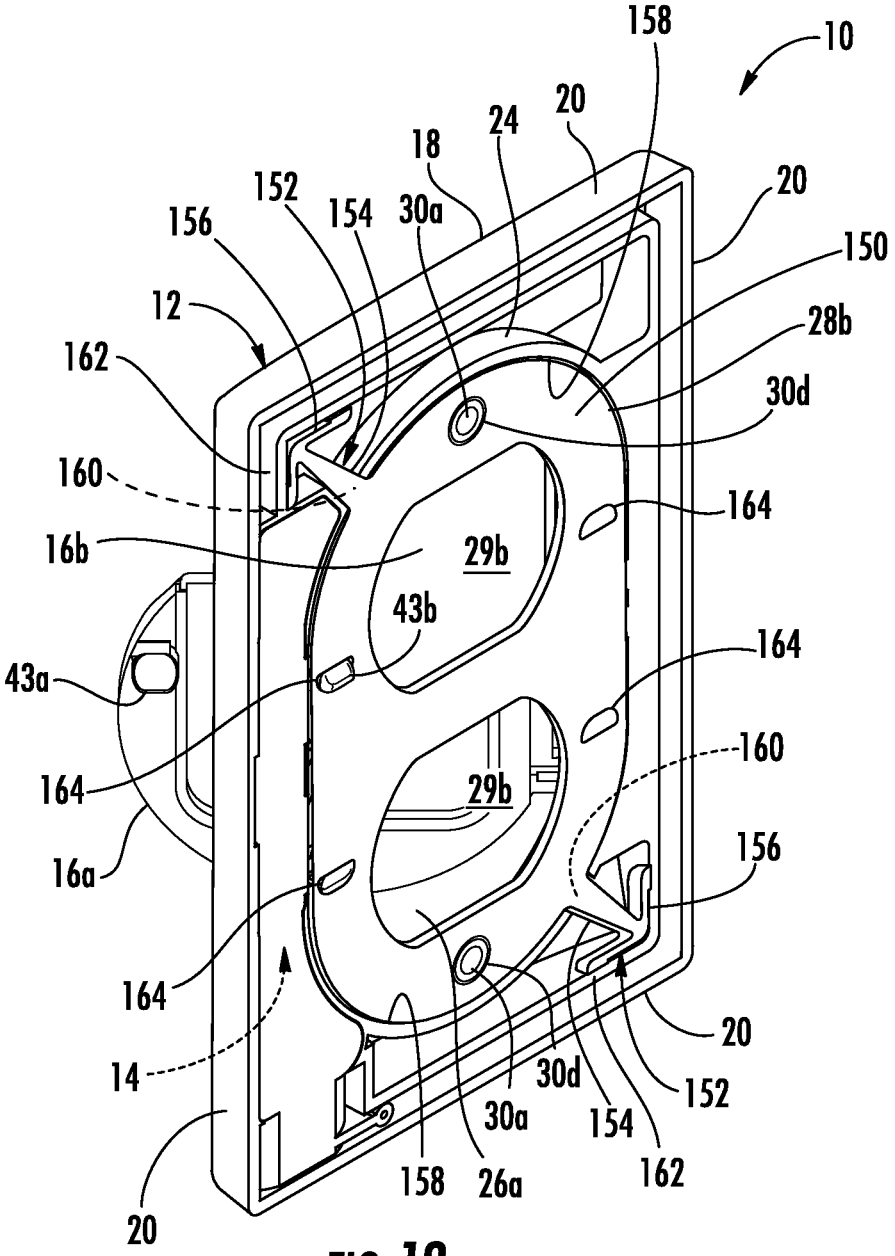
FIG. 18 is a top, left, rear perspective view of the outlet cover of FIG. 17.
Figure 19:
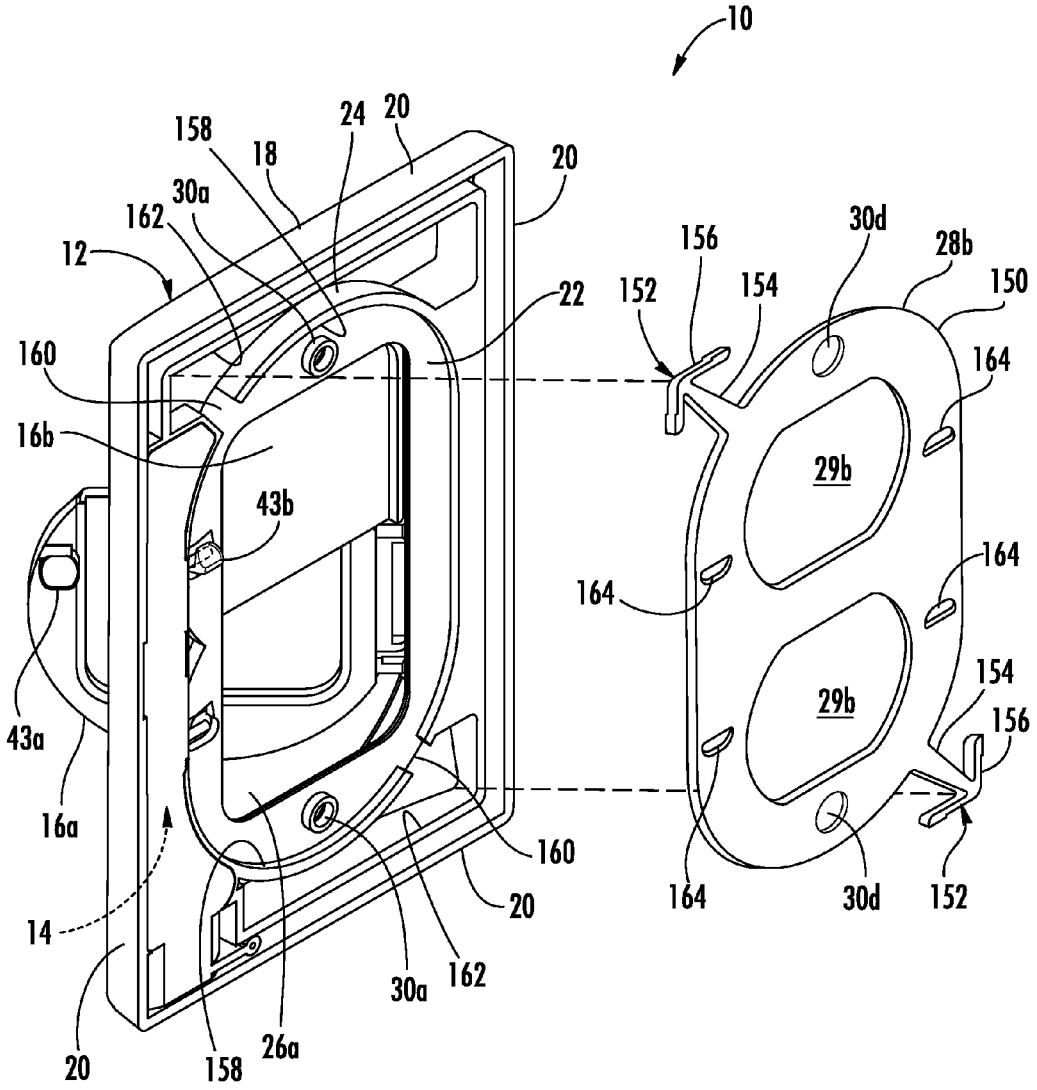
FIG. 19 is a top, left, rear perspective view of the outlet cover of FIG. 18, showing the template spaced from the outlet cover.

Referring to FIGS. 17-19, a template 29*a* is illustrated for use with the invented outlet cover 10. The template 29*a* adapts the cover 10 for use with a standard duplex outlet. The template 29*a* includes a member 150 defining a pair of openings 26*b* for accessing an outlet, arrow shaped guides 152 having a shaft 154 and arrow head end portion 156, and openings 162 for accommodating protrusion of the latches (only latch 43*b* shown). Extra openings 162 are provided so that the template 29*a* is reversible. The template 29*a* sits on the second section 22 and within the first guide wall 158 to properly position the template 29*a*. The arrow shaped guides 152 also assist in positioning the template 29*a* by having the shafts 154 extend through cut-outs 160 in the first guide wall 158 and the arrow head end portions 156 confined by second guide wall of the outlet cover 10.

Figure 20:
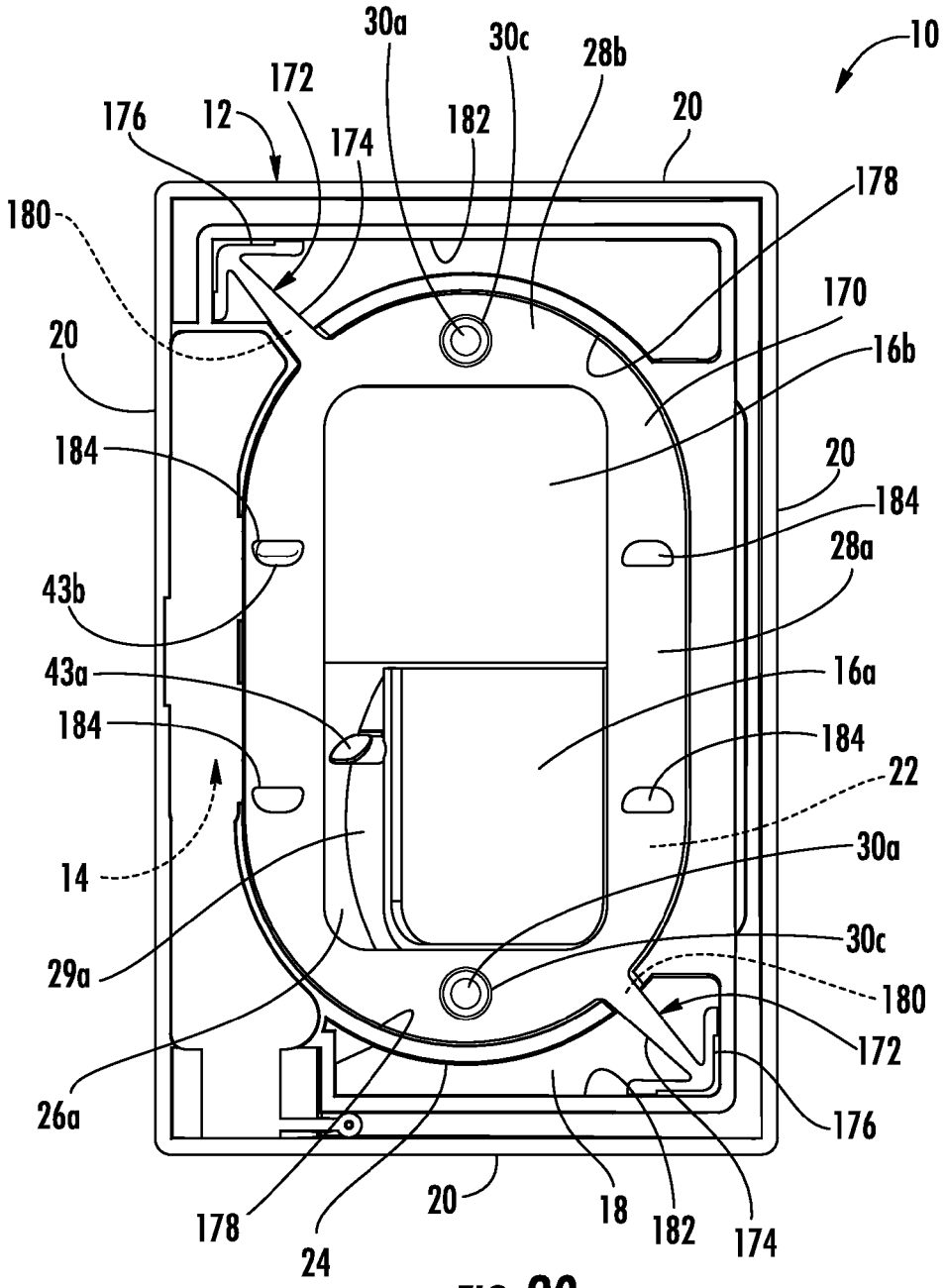
FIG. 20 is a rear view of the outlet cover of FIG. 2, further showing a template insert suitable for accommodating application of the cover to a GFI electrical outlet.
Figure 21:
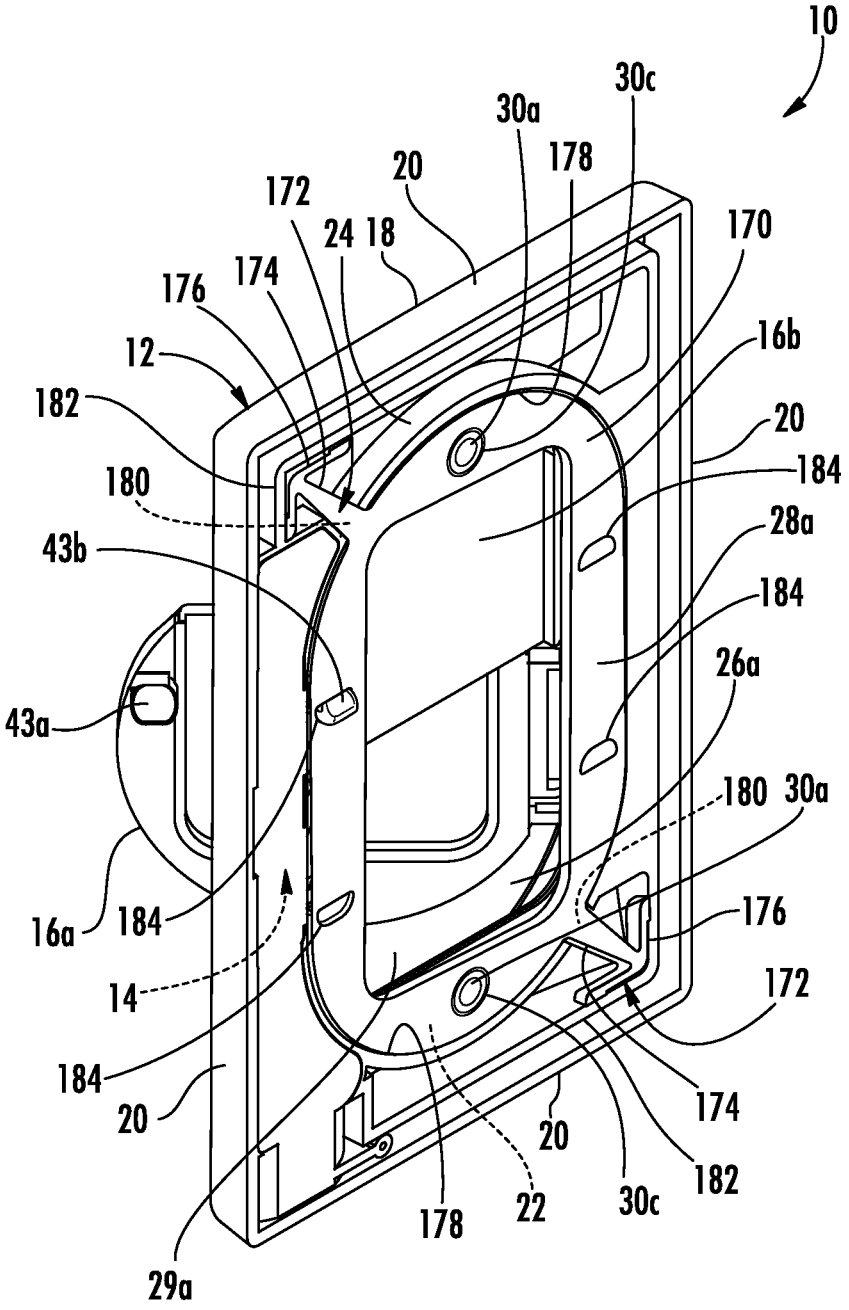
FIG. 21 top, left, rear perspective view of the outlet cover of FIG. 20.
Figure 22:
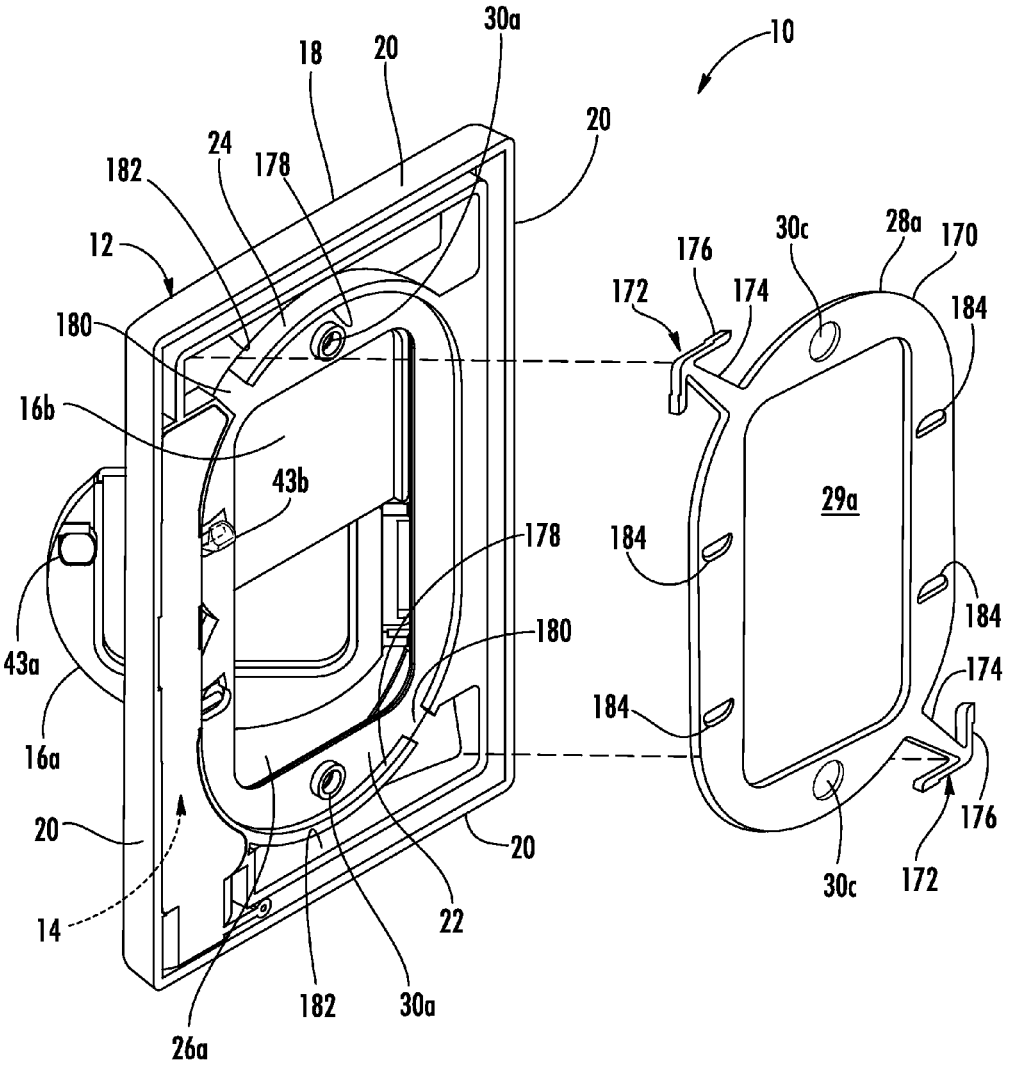
FIG. 22 is a top, left, rear perspective view of the outlet cover of FIG. 21, showing the template spaced from the outlet cover.

Referring to FIGS. 20-22, a template 29*b* is illustrated for use with the invented outlet cover 10. The template 29*b* adapts the cover 10 for use with a GFI duplex outlet. The template 29*b* includes a member 170 defining an opening 26*a* for accessing an outlet, arrow shaped guides 172 having a shaft 174 and arrow head end portion 176, and openings 184 for accommodating protrusion of the latches (only latch 43*b* shown). Extra openings 184 are provided so that the template 29*b* is reversible. The template 29*b* sits on the second section 22 and within the first guide wall 178 to properly position the template 29*b*. The arrow shaped guides 172 also assist in positioning the template 29*b* by having the shafts 174 extend through cut-outs 180 in the first guide wall 178 and the arrow head end portions 176 confined by second guide wall 182 of the outlet cover 10.

It is contemplated and within the scope of this application that the invented outlet cover may be modified to have more or less of the elements, and that the elements may be of different shapes and sizes, than that described herein and still perform an equivalent function. For example, the invented outlet cover may be configured with a singular lid, include three of more lids, and/or having openings suitable for application with different types of electrical receptacles, and the like. It is further contemplated that different means for allowing the locking pins to move between the locking, intermediate and unlocking positions may be provided. For example, an arrangement of pins and compression springs may allow for the pins to move linearly, instead of radially has described herein with the preferred embodiments.

The foregoing provides a detailed description of exemplary embodiments of the present invention. Although an outlet cover with a locking assembly for use with an electrical outlet has been described with reference to preferred embodiments and examples thereof, other embodiments and examples may perform similar functions and/or achieve similar results. All such equivalent embodiments and examples are within the spirit and scope of the present invention and are intended to be covered by the following claims.

That which is claimed is:

1. An outlet cover for an electrical outlet, comprising:

a plate having an opening capable of receiving an electrical plug;

a lid hingedly attached to the plate, the lid being movable from an open position wherein the opening is not covered by the lid to a closed position wherein the opening is covered by the lid and the lid is locked in position relative to the plate;

a locking assembly attached to the plate and having a pin, the locking assembly being moveable relative to the plate from a first position, wherein the lid is capable of being rotated from the open position to the closed position, to a second position wherein the lid is capable of being moved from the closed position to the open position;

wherein the pin is movable relative to the locking assembly from a locking position to an intermediate position and then to the locking position when the locking assembly is in the first position and the lid is moved from the open position to the closed position;

wherein the pin is carried by and moves linearly with the locking assembly when the locking assembly moves from the first position to the second position; and wherein the pin is rotatably attached to the locking assembly.

2. An outlet cover for an electrical outlet, comprising:

a plate having an opening capable of receiving an electrical plug;

a lid hingedly attached to the plate, the lid being movable from an open position wherein the opening is not covered by the lid to a closed position wherein the opening is covered by the lid and the lid is locked in position relative to the plate;

a locking assembly attached to the plate and having a pin, the locking assembly being moveable relative to the plate from a first position, wherein the lid is capable of being rotated from the open position to the closed position, to a second position wherein the lid is capable of being moved from the closed position to the open position;

wherein the pin is movable relative to the locking assembly from a locking position to an intermediate position and then to the locking position when the locking assembly is in the first position and the lid is moved from the open position to the closed position;

wherein the pin is carried by and moves linearly with the locking assembly when the locking assembly moves from the first position to the second position; and wherein the locking assembly includes a spring, wherein the spring engages the pin and biases the pin towards the locking position.

3. The outlet cover in accordance with claim 1, wherein the lid has a latch and the latch causes the pin to move between the locking position and the intermediate position when the lid is moved from the open position to the closed position and the locking assembly is in the first position.

4. The outlet cover in accordance with claim 3, wherein the latch engages the pin and locks the lid in the closed position when the lid is in the closed position, the locking assembly is in the first position, and the pin is in the locking position.

5. The outlet cover in accordance with claim 2, wherein the lid has a latch and the latch causes the pin to move between the locking position and the intermediate position when the lid is moved from the open position to the closed position and the locking assembly is in the first position.

6. The outlet cover in accordance with claim 5, wherein the latch engages the pin and locks the lid in the closed position when the lid is in the closed position, the locking assembly is in the first position, and the pin is in the locking position.

* * * * *